US011531300B1

(12) United States Patent
Miyagawa et al.

(10) Patent No.: US 11,531,300 B1
(45) Date of Patent: Dec. 20, 2022

(54) IMAGE FORMING APPARATUS

(71) Applicant: FUJIFILM Business Innovation Corp., Tokyo (JP)

(72) Inventors: Shohei Miyagawa, Kanagawa (JP); Mitsuaki Kuroda, Kanagawa (JP); Naoya Kamigaito, Kanagawa (JP); Satoshi Matsuzaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/578,898

(22) Filed: Jan. 19, 2022

(30) Foreign Application Priority Data

Aug. 25, 2021 (JP) ..... JP2021-136803

(51) Int. Cl.
*G03G 21/18* (2006.01)

(52) U.S. Cl.
CPC ..... *G03G 21/1842* (2013.01)

(58) Field of Classification Search
CPC ..... G03G 21/1842
See application file for complete search history.

(56) References Cited

U.S. PATENT DOCUMENTS 6,263,177 B1 * 7/2001 Shifley ..... G03G 15/751 399/117
6,272,299 B1 * 8/2001 Numagami ..... G03G 21/1867 399/111
2002/0018666 A1 * 2/2002 Noda ..... G03G 21/1647 399/90
2003/0198490 A1 * 10/2003 Sugiyama ..... G03G 15/0813 399/269
2008/0199212 A1 * 8/2008 Tsui ..... G03G 21/1864 399/111
2014/0093279 A1 * 4/2014 Hayakawa ..... G03G 21/1676 399/117
2015/0261180 A1 * 9/2015 Sato ..... G03G 21/1619 399/111
2016/0004214 A1 * 1/2016 Sato ..... G03G 21/1619 399/111
2021/0325805 A1 10/2021 Kodera et al.

FOREIGN PATENT DOCUMENTS

| | | | |
|---|---|---|---|
| EP | 0 671 667 | A2 | 9/1995 |
| JP | 10-90967 | A | 4/1998 |
| JP | 2004-246374 | A | 9/2004 |
| JP | 2010-78721 | A | 4/2010 |
| JP | 2012234073 | A * | 11/2012 |
| JP | 2020-148962 | A | 9/2020 |

OTHER PUBLICATIONS

Extended European Search Report dated Sep. 19, 2022 in European Application No. 22166240.6.

* cited by examiner

*Primary Examiner* — Francis C Gray
(74) *Attorney, Agent, or Firm* — Sughrue Mion, PLLC

(57) ABSTRACT

An image forming apparatus includes an apparatus housing, and an imaging module that is removably installed in the apparatus housing. The imaging module includes an image carrier unit that is capable of carrying an image, an image writer unit that writes an image on the image carrier unit, and a module housing that registers and removably holds the image carrier unit and the image writer unit. A fastening unit that registers the module housing with respect to the apparatus housing and that removably fastens the module housing is disposed between the apparatus housing and the module housing.

13 Claims, 20 Drawing Sheets

IMAGE FORMING APPARATUS

CROSS-REFERENCE TO RELATED APPLICATIONS

This application is based on and claims priority under 35 USC 119 from Japanese Patent Application No. 2021-136803 filed Aug. 25, 2021.

BACKGROUND

(i) Technical Field

The present disclosure relates to an image forming apparatus.

(ii) Related Art

Known image forming apparatuses are disclosed in, for example, Japanese Unexamined Patent Application Publication No. 2020-148962 (Detailed Description, and FIG. 1) and Japanese Unexamined Patent Application Publication No. 2010-78721 (Best Mode for Carrying Out the Disclosure, FIG. 4).

In Japanese Unexamined Patent Application Publication No. 2020-148962, a transport portion (a chain-driven gripper system) that transports a recording medium for processes from transferring to fixing is provided, a transfer drum is disposed in a transfer region of the transport portion, and a fixing device that includes a pressure body and a heat roller is disposed in a fixing region of the transport portion.

Japanese Unexamined Patent Application Publication No. 2010-78721 discloses an image formation cartridge that includes an image carrier on which an electrostatic latent image is formed by exposure to light, an exposure unit that exposes the image carrier to the light by using multiple light-emitting elements, a housing that contains the image carrier and the exposure unit and that is installable in an image forming apparatus, an insertion portion that is disposed in the housing and that receives a connection unit that is included in the image forming apparatus and that is inserted when the housing is installed at a predetermined position in the image forming apparatus, and a connection unit that is disposed in the housing, that is electrically connected to the connection unit that is inserted into the insertion portion when the housing is installed at the predetermined position in the image forming apparatus, and that transmits a signal to the exposure unit.

SUMMARY

Aspects of non-limiting embodiments of the present disclosure relate to an image forming apparatus that concentrates a vibration transmission path on a region that extends from an apparatus housing to a module housing and that inhibits an image carrier unit and an image writer unit that are held in the module housing from being misregistered due to a vibration.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an apparatus housing, and an imaging module that is removably installed in the apparatus housing, wherein the imaging module includes an image carrier unit that is capable of carrying an image, an image writer unit that writes an image on the image carrier unit, and a module housing that registers and removably holds the image carrier unit and the image writer unit, and wherein a fastening unit that registers the module housing with respect to the apparatus housing and that removably fastens the module housing is disposed between the apparatus housing and the module housing.

BRIEF DESCRIPTION OF THE DRAWINGS

Exemplary embodiments of the present disclosure will be described in detail based on the following figures, wherein.

DETAILED DESCRIPTION

Summary of Exemplary Embodiment

Figure 1A:
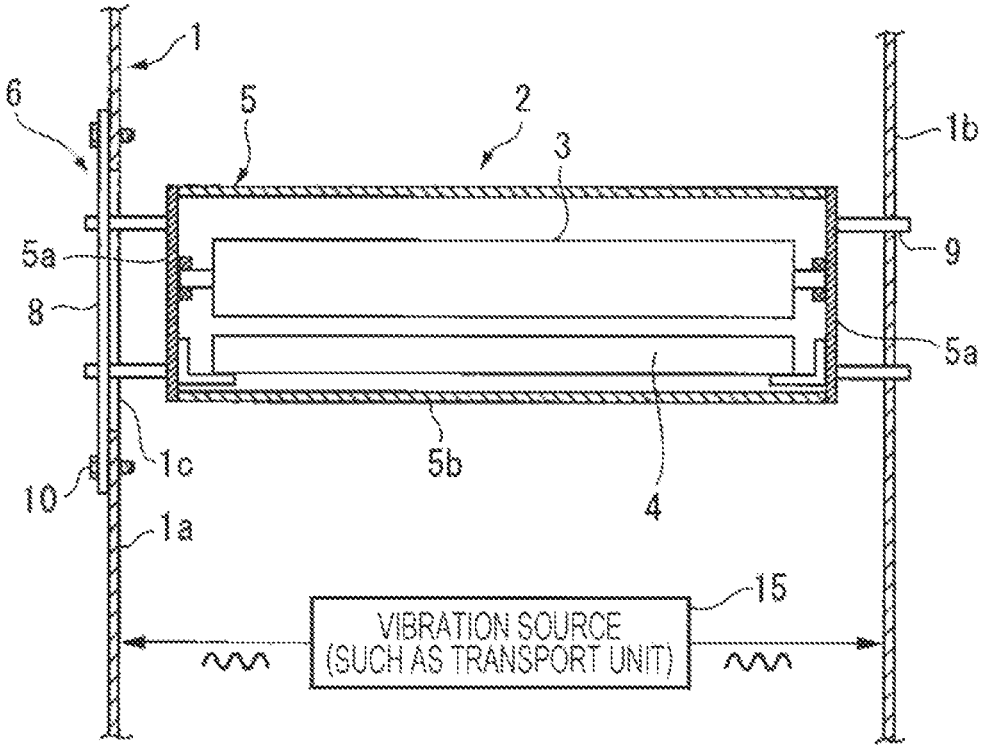
FIG. 1A schematically illustrates an image forming apparatus according to an exemplary embodiment of the present disclosure.

FIG. 1A schematically illustrates an image forming apparatus according to an exemplary embodiment of the present disclosure.

In the figure, the image forming apparatus includes an apparatus housing 1 and an imaging module 2 that is removably installed in the apparatus housing 1. The imaging module 2 includes an image carrier unit 3 that is capable of carrying an image, an image writer unit 4 that writes an image on the image carrier unit 3, and a module housing 5 that registers and removably holds the image carrier unit 3 and the image writer unit 4. A fastening unit 6 that registers the module housing 5 with respect to the apparatus housing 1 and that removably fastens the module housing 5 is disposed between the apparatus housing 1 and the module housing 5.

With such a technical measure, the apparatus housing 1 includes not only a fundamental housing frame that forms the fundamental housing shape of the image forming apparatus but also a separate housing frame (for example, a housing of a transfer module) that is integrally fastened to the fundamental housing frame.

The separate housing frame (a separate housing frame that adheres to the fundamental housing frame) such as the housing of the transfer module serves as a fastening portion for the module housing 5 in addition to the fundamental housing frame in order to install the imaging module 2. Based on this, it is clarified that the apparatus housing 1 includes not only the fundamental housing frame but also the separate housing frame.

Examples of the image carrier unit 3 include a wide range of components such as a photoconductor member and a dielectric, and the form thereof is not limited by neither a drum nor a belt.

The image writer unit 4 is not limited to an optical write head (for example, a LED print head (LPH), or a surface emitting laser), and examples thereof include a wide range of components that are incorporated into the module housing 5 such as an ion flow write head.

Examples of the fastening unit 6 include a wide range of components that register and fasten the module housing 5 at a predetermined location in the apparatus housing 1, provided that the module housing 5 is removable from the apparatus housing 1 in a manner in which the fastening unit 6 releases the module housing 5 that is fastened.

Figure 20A:
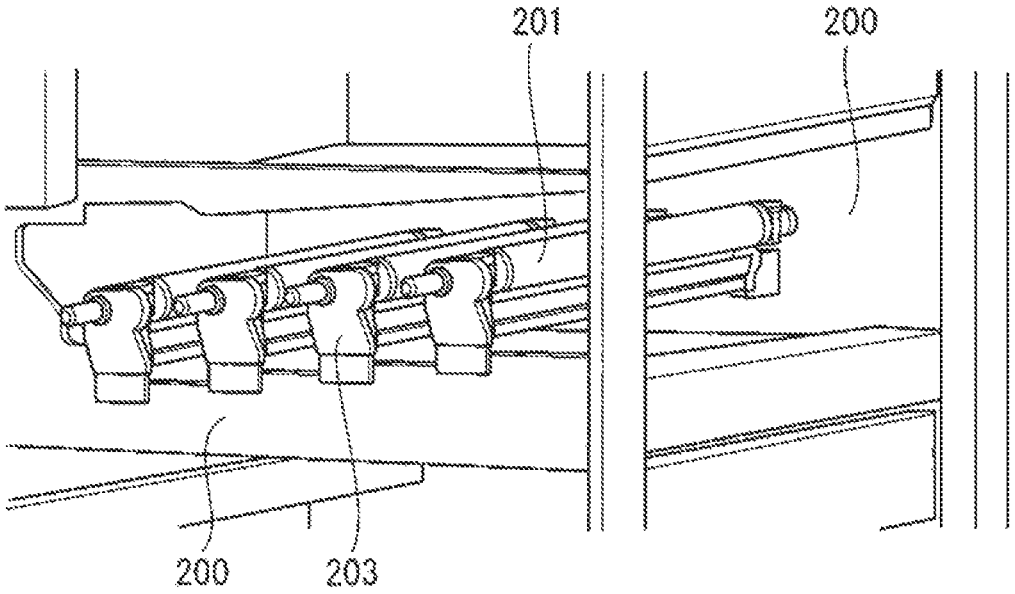
FIG. 20A illustrates a structure for supporting a photoconductor member of an image forming apparatus in a first comparative example on an apparatus housing.
Figure 20B:
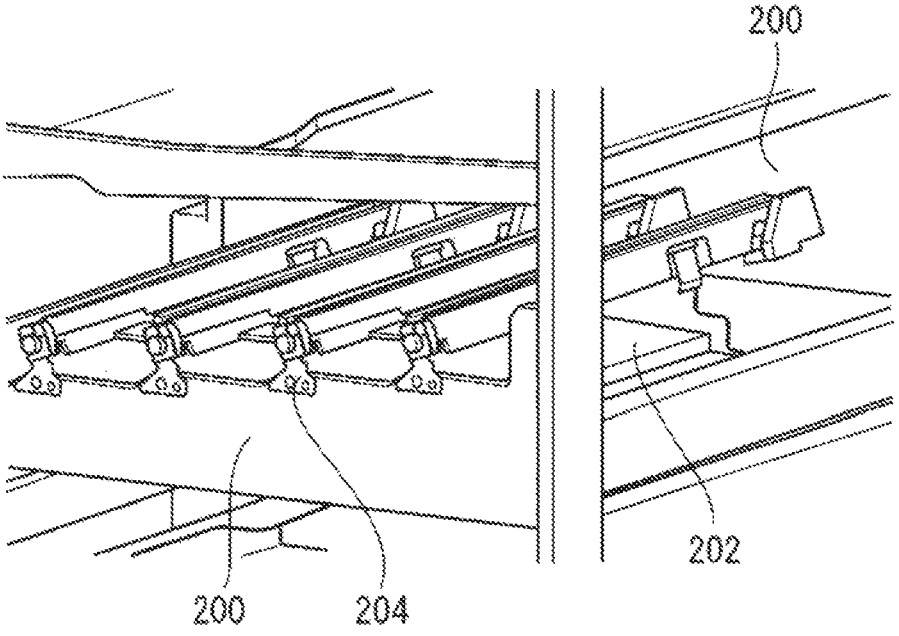
FIG. 20B illustrates a structure for supporting a LED head of the image forming apparatus in the first comparative example on the apparatus housing.

In this aspect, as illustrated in, for example, FIG. 1A, an image that is formed by the imaging module 2 is typically transferred to a recording material that is transported by a transport unit not illustrated in the image forming apparatus. The transport unit, for example, becomes a vibration source 15, and a vibration is transmitted to the image carrier unit 3 and the image writer unit 4 via the apparatus housing 1. In a first comparative example illustrated in FIG. 20A and FIG. 20B where a photoconductor member 201 that serves as an image carrier unit and an optical write head 202 that serves as an image writer unit are supported by using support brackets 203 and 204 that are separate support units on an apparatus housing 200. A vibration transmission path that extends from the apparatus housing 200 to the photoconductor member 201 that serves as the image carrier unit and a vibration transmission path that extends from the apparatus housing 200 to the optical write head 202 that serves as the image writer unit differ from each other. Accordingly, different vibrations are transmitted, and there is a concern that an image that is written by the optical write head 202 that serves as the image writer unit is misregistered with respect to the photoconductor member 201 that serves as the image carrier unit.

According to the present exemplary embodiment, however, the image carrier unit 3 and the image writer unit 4 are registered and held in the module housing 5, and the module housing 5 is registered and fastened to the apparatus housing 1 by using the fastening unit 6. For this reason, in this example, a vibration transmission path from the vibration source 15 is concentrated on the apparatus housing 1 and the module housing 5, and the image carrier unit 3 and the image writer unit 4 that are registered and held in the module housing 5 vibrate together due to the same vibration transmission path.

In this example, as illustrated in FIG. 1A, the imaging module 2 is incorporated into the apparatus housing 1, and the module housing 5 is registered with respect to the apparatus housing 1 and fastened by using the fastening unit 6.

Figure 1B:
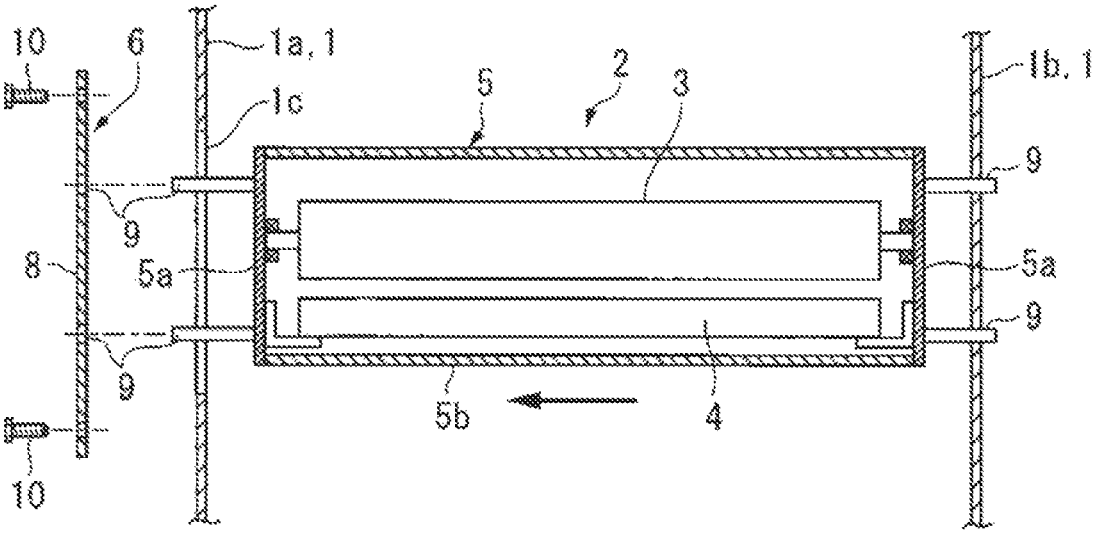
FIG. 1B illustrates an operation of installing and removing an imaging module in and from an apparatus housing.

As illustrated in FIG. 1B, the fastening unit 6 releases the module housing 5 that is fastened, and the module housing 5 that is fastened is consequently released from the apparatus housing 1. This enables the imaging module 2 to be pulled from the apparatus housing 1.

Typical aspects of the image forming apparatus according to the present exemplary embodiment will now be described.

In a typical aspect for the apparatus housing 1 and the module housing 5, the apparatus housing 1 includes a front housing side frame 1*a* and a rear housing side frame 1*b* that interpose the module housing 5 therebetween in the installation-removal direction of the imaging module 2, and the front housing side frame 1*a* that is located at a front in the installation-removal direction of the imaging module 2 has an opening 1*c* for installation and removal of the imaging module 2.

In this example, the imaging module 2 may be pulled and put via the opening 1*c* for installation and removal in the front housing side frame 1*a*.

In a typical aspect for the fastening unit 6 of the apparatus housing 1, the fastening unit 6 registers the module housing 5 with respect to the rear housing side frame 1*b* that is located at a rear in the installation-removal direction of the imaging module 2, registers the module housing 5 with respect to the front housing side frame 1*a* by using a fastening arm 8, and fastens the module housing 5.

In this example, the fastening unit 6 may be such that the number of support points that include a register point and a fastening point of the fastening arm 8 is larger than the number of a register point of the rear housing side frame 1*b*.

From the perspective of an increase in the rigidity of the module housing 5 and ease of installation and removal operations, the module housing 5 may include a pair of hold frames 5*a* that holds both ends of the image carrier unit 3 and the image writer unit 4 in the longitudinal direction and a connection frame 5*b* that connects the hold frames 5*a* to each other, and a part of a register factor 9 (for example, a register pin) of the fastening unit 6 may be formed on the pair of hold frames 5*a*.

In a typical aspect for the fastening unit 6, the fastening unit 6 includes the register factor 9 that registers the module housing 5 with respect to the apparatus housing 1 and a fastening factor 10 that fastens the module housing 5 to the apparatus housing 1.

In this aspect, the register factor 9 may include multiple portions to be registered at predetermined locations on the module housing 5 and multiple register portions that are disposed on the apparatus housing 1 or the fastening unit 6 and that are involved with the multiple portions to be registered.

The fastening factor 10 may be configurated such that a fastening position is adjustable and is capable of fastening the module housing 5 that is registered after the module housing 5 is registered with respect to the apparatus housing 1.

In another typical aspect for the fastening unit 6, the fastening unit 6 includes the fastening arm 8 that is disposed across the apparatus housing 1 and the module housing 5, and a register point for the module housing 5 and a fastening point for the apparatus housing 1 are set at the fastening arm 8.

In this example, the fastening arm 8 may include an elongated arm member that has two ends at which the fastening points for the apparatus housing 1 are set, and the position of the center of the image carrier unit 3 and the position on the image carrier unit 3 at which the image writer unit 4 writes the image are located on a straight line that connects the fastening points to each other.

In this example, the fastening arm 8 includes the elongated arm member that has the two ends at which the fastening points are set, and accordingly, the fastening arm 8 vibrates from the fastening points at both ends. At this time, since the position of the center of the image carrier unit 3 and the position at which the image writer unit 4 writes the image are located on the straight line that connects the fastening points at both ends of the fastening arm 8 to each other, a measure against the vibration mode of the fastening arm 8 is readily planned.

In an aspect, the apparatus housing 1 includes the fundamental housing frame that forms the fundamental housing shape of the image forming apparatus and the separate housing frame that is fastened to the fundamental housing frame as described above, and the fastening arm 8 is disposed across the fundamental housing frame and the separate housing frame.

In this aspect, the fastening arm 8 may be such that the number of the support points that include the register point and the fastening point is larger than that in the case where the fastening arm 8 is disposed across only the fundamental housing frame. That is, the vibration transmission path along which a vibration is transmitted from the vibration source 15 to the fundamental housing frame and the vibration transmission path along which the vibration from the vibration source 15 is transmitted to the fundamental housing frame and the separate housing frame differ from each other. Accordingly, the transmitted vibration may be electively reduced in a manner in which the number of the support points on the course on which the vibration is transmitted to the module housing 5 via the fastening arm 8 is increased.

Exemplary embodiments of the present disclosure illustrated in the accompanying drawings will hereinafter be described in detail.

First Exemplary Embodiment

Entire Configuration of Image Forming Apparatus

Figure 2:
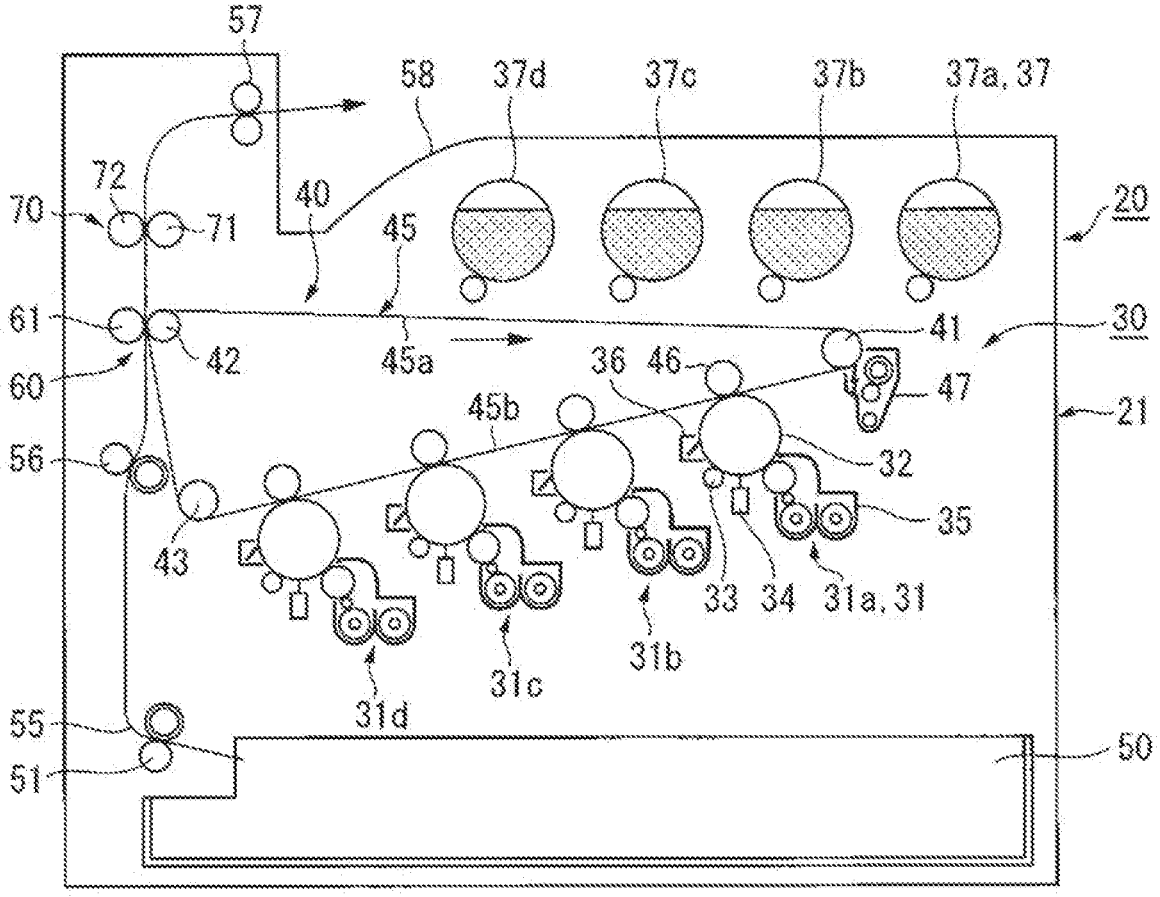
FIG. 2 illustrates the entire configuration of an image forming apparatus according to a first exemplary embodiment.

FIG. 2 illustrates the entire configuration of an image forming apparatus according to a first exemplary embodiment.

In the figure, an image forming apparatus 20 includes an imaging engine 30 that forms images in multiple colors (four colors of yellow, magenta, cyan, and black according to the present exemplary embodiment) in an apparatus housing 21. A recording-material supply device 50 that contains a recording material such as a sheet is disposed below the imaging engine 30. A recording-material transport path 55 extends from the recording-material supply device 50 substantially in the vertical direction.

In this example, as for the imaging engine 30, image forming units 31 (specifically, 31*a* to 31*d*) that form the images in the multiple colors are arranged sideways (in an oblique direction that slightly tilts downward with respect to the horizontal direction in this example), a transfer module 40 that includes an intermediate transfer body 45 that turns in the direction in which the image forming units 31 are arranged and that has, for example, a belt shape is disposed above the image forming units 31, and the images in the respective colors that are formed by the respective image forming units 31 are transferred to the recording material by using the transfer module 40.

According to the present exemplary embodiment, as illustrated in FIG. 2, the image forming units 31 (31*a* to 31*d*) form, for example, toner images in yellow, magenta, cyan, and black in order from an upstream position in the direction in which the intermediate transfer body 45 turns (arrangement is not limited by this order). Each image forming unit 31 includes a photoconductor member 32, a charger (a charging roller in this example) 33 that charges the photoconductor member 32 in advance, an optical write head (a LED write head in this example) 34 that writes an electrostatic latent image on the photoconductor member 32 that is charged by the charger 33, and a development unit 35 that develops the electrostatic latent image that is formed on the photoconductor member 32 by using toner that contains a corresponding color component (for example, negative polarity according to the present exemplary embodiment), and a cleaner 36 that cleans residues on the photoconductor member 32.

A reference character 37 (specifically, 37*a* to 37*d*) represents toner cartridges that supply the toner that contains the corresponding color component to the development unit 35.

According to the present exemplary embodiment, the transfer module 40 is formed by stretching the intermediate transfer body 45 that has a belt shape into a substantially triangular shape by using multiple stretch rollers 41 to 43. For example, the stretch roller 41 is used as a drive roller to cause the intermediate transfer body 45 to turn. In this example, the intermediate transfer body 45 includes a horizontal portion 45*a* that extends substantially in the horizontal direction and a tilt portion 45*b* that obliquely extends downward with respect to the horizontal portion 45*a*. The image forming units 31 (31*a* to 31*d*) described above are arranged sideways below the tilt portion 45*b* of the intermediate transfer body 45.

Transfer units (transfer rollers in this example) 46 for first transfer are disposed on the back surface of the intermediate transfer body 45 so as to face the respective photoconductor members 32 of the image forming units 31. A transfer voltage that has polarity opposite the charge polarity of the toner is applied to the transfer units 46, and consequently, the toner images on the photoconductor members 32 are electrostatically transferred to the intermediate transfer body 45.

A belt cleaner 47 is disposed upstream of the image forming unit 31*a* at the most upstream position among the others on the intermediate transfer body 45 and removes residual toner on the intermediate transfer body 45.

According to the present exemplary embodiment, a second transfer unit 60 is disposed so as to face the stretch roller 42 downstream of the image forming unit 31*d* at the most downstream position among the others on the intermediate transfer body 45 and a first transfer image on the intermediate transfer body 45 is second-transferred (collectively transferred) to the recording material.

In this example, the second transfer unit 60 includes a second transfer roller 61 that is disposed such that the second transfer roller 61 is pressed against a surface of the intermediate transfer body 45 on which the toner images are carried and a backup roller that is disposed on the back surface of the intermediate transfer body 45 and that serves as a facing electrode for the second transfer roller 61 (the stretch roller 42 doubles as the backup roller in this example). For example, the second transfer roller 61 is grounded, and a second transfer voltage that has the same polarity as the charge polarity of the toner is applied to the backup roller (the stretch roller 42).

The recording-material supply device 50 includes a supply roller 51 that supplies the recording material. A transport roller, not illustrated, is disposed on the recording-material transport path 55. A register roller (a registration roller) 56 that supplies the recording material to a second transfer portion with a predetermined timing is disposed on the recording-material transport path 55 right in front of the second transfer portion.

A fixing unit 70 is disposed on the recording-material transport path 55 at a position downstream of the second transfer portion. For example, the fixing unit 70 includes a heat fixing roller 71 that contains a heater not illustrated and a pressure fixing roller 72 that is pressed against the heat fixing roller 71 and is rotated. Discharge rollers 57 that discharge the recording material in the apparatus housing 21 are disposed downstream of the fixing unit 70, transport the recording material with the recording material interposed therebetween, and discharge the recording material such that the recording material is contained in a recording-material container 58 that is formed above the apparatus housing 21.

In this example, a supply unit for manually feeding the recording material or a double-sided recording module that enables double-sided recording on the recording material may be additionally provided although this is not illustrated.

Configuration of Imaging Module

Figure 3:
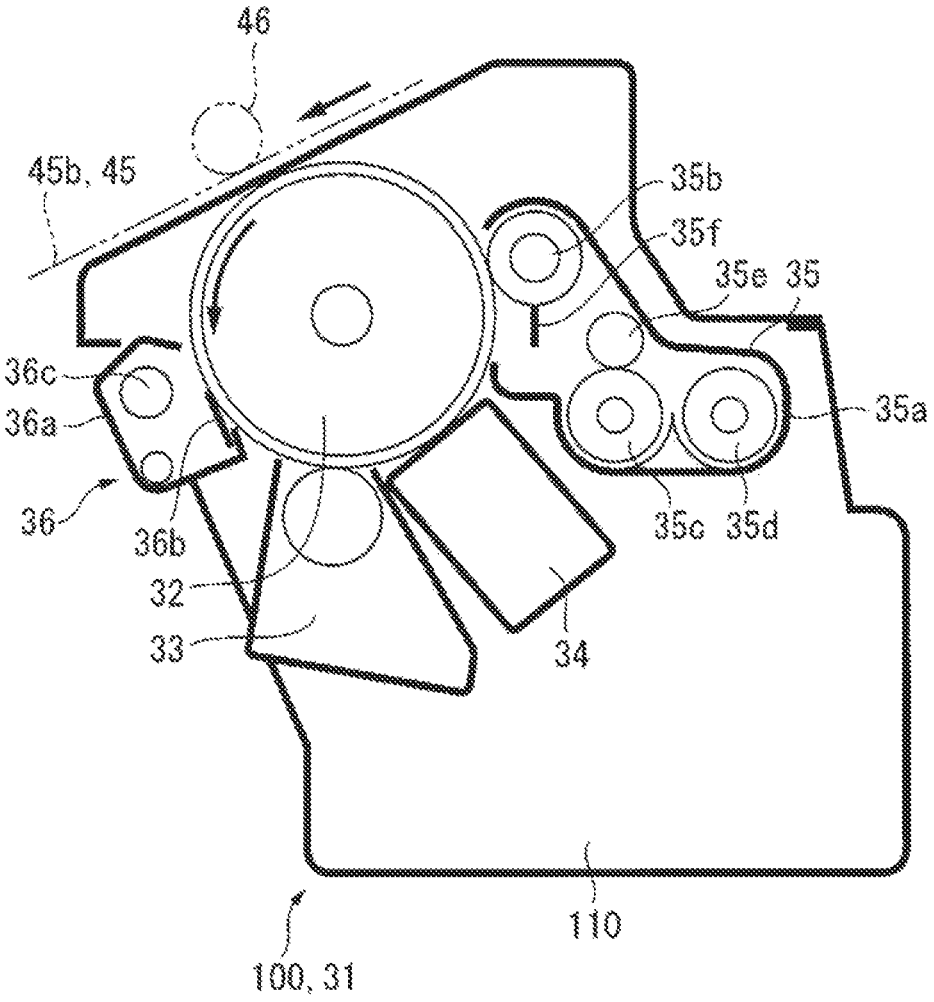
FIG. 3 illustrates a principal component of an imaging module according to the first exemplary embodiment.

According to the present exemplary embodiment, as illustrated in FIG. 3, each image forming unit 31 (31*a* to 31*d*) is configurated as an imaging module 100, and devices such as the photoconductor member 32, the charger 33, the optical write head 34, the development unit 35, and the cleaner 36 are registered and held in a single module housing 110.

In this example, each imaging module 100 is disposed below the transfer unit 46 of the transfer module 40. The photoconductor member 32 faces the transfer unit 46. The charger 33 is disposed right below the photoconductor member 32. The optical write head 34 and the development unit 35 are arranged in the direction of rotation of the photoconductor member 32. The cleaner 36 is disposed upstream of the charger 33 in the direction of rotation of the photoconductor member 32.

In this example, as illustrated in FIG. 3, the development unit 35 includes a development container 35*a* that contains a developer containing the toner and a carrier and that has an opening that faces the photoconductor member 32, and a development roller 35*b* is disposed at the opening of the development container 35*a*. The development roller 35*b* holds the developer, and the developer is supplied to a portion that faces the photoconductor member 32. Mixing transport members 35*c* and 35*d* that mix, charge, and transport the developer are disposed in the development container 35*a*. A developer supply member 35*e* is disposed between the development roller 35*b* and the mixing transport member 35*c*. A restriction member 35*f* that restricts the amount of the developer that is supplied to the development roller 35*b* is disposed near the development roller 35*b*.

In this example, the cleaner 36 includes a cleaning container 36*a* that contains residues on the photoconductor member 32 and has an opening that faces the photoconductor member 32. A cleaning blade 36*b* that serves as a cleaning member that has a plate shape for scraping the residues on the photoconductor member 32 is mounted along an edge around the opening of the cleaning container 36*a*. A mixing transport member 36*c* that flattens and transports the contained residues is disposed in the cleaning container 36*a*.

Example of Configuration of Module Housing

Figure 4:
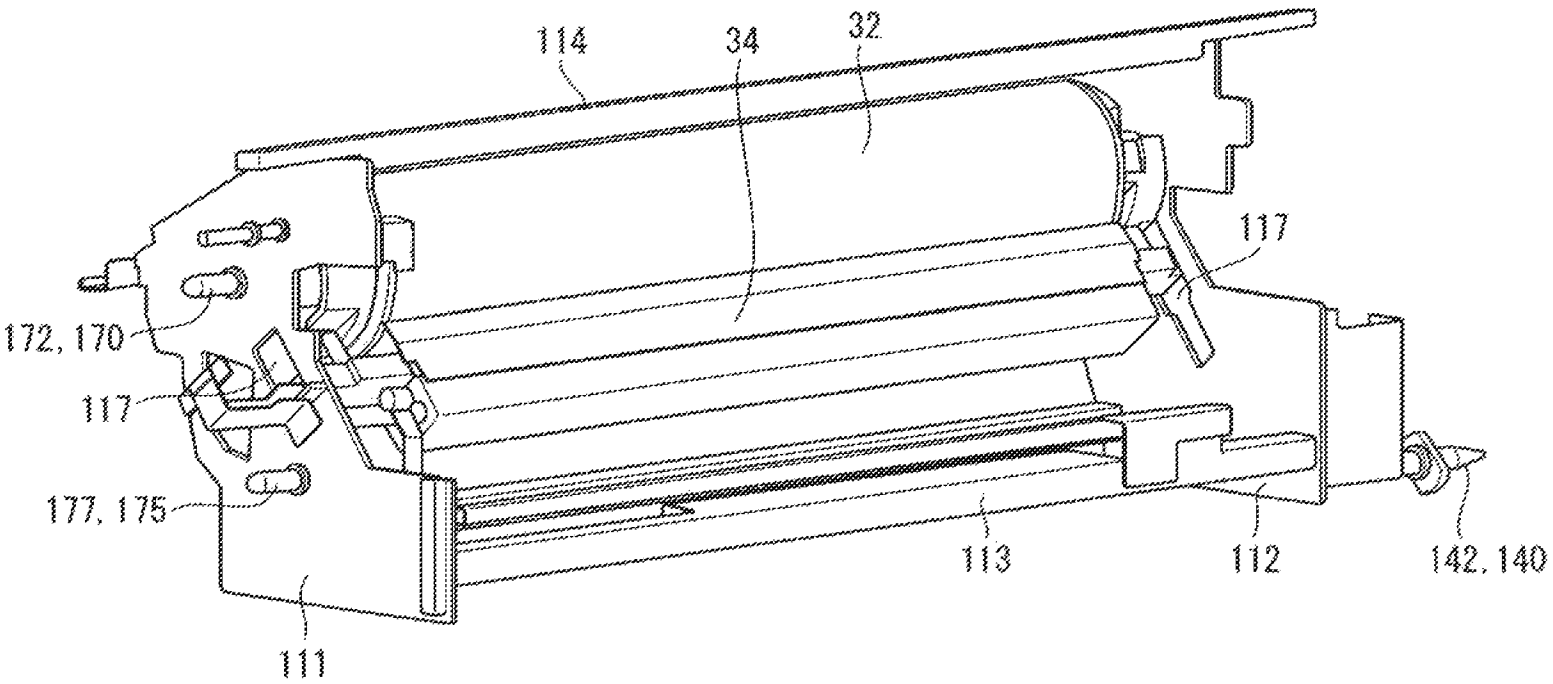
FIG. 4 is a perspective view of the imaging module according to the first exemplary embodiment.

According to the present exemplary embodiment, as illustrated in FIG. 4, the module housing 110 includes a pair of hold frames 111 and 112 that holds both ends of the photoconductor member 32 and the optical write head 34 in the longitudinal direction and connection frames 113 and 114 that connect the hold frames 111 and 112 to each other. In FIG. 4, only the photoconductor member 32 and the optical write head 34 are illustrated as devices that are incorporated in the imaging module 100, and an illustration of other devices is omitted.

Figure 5:
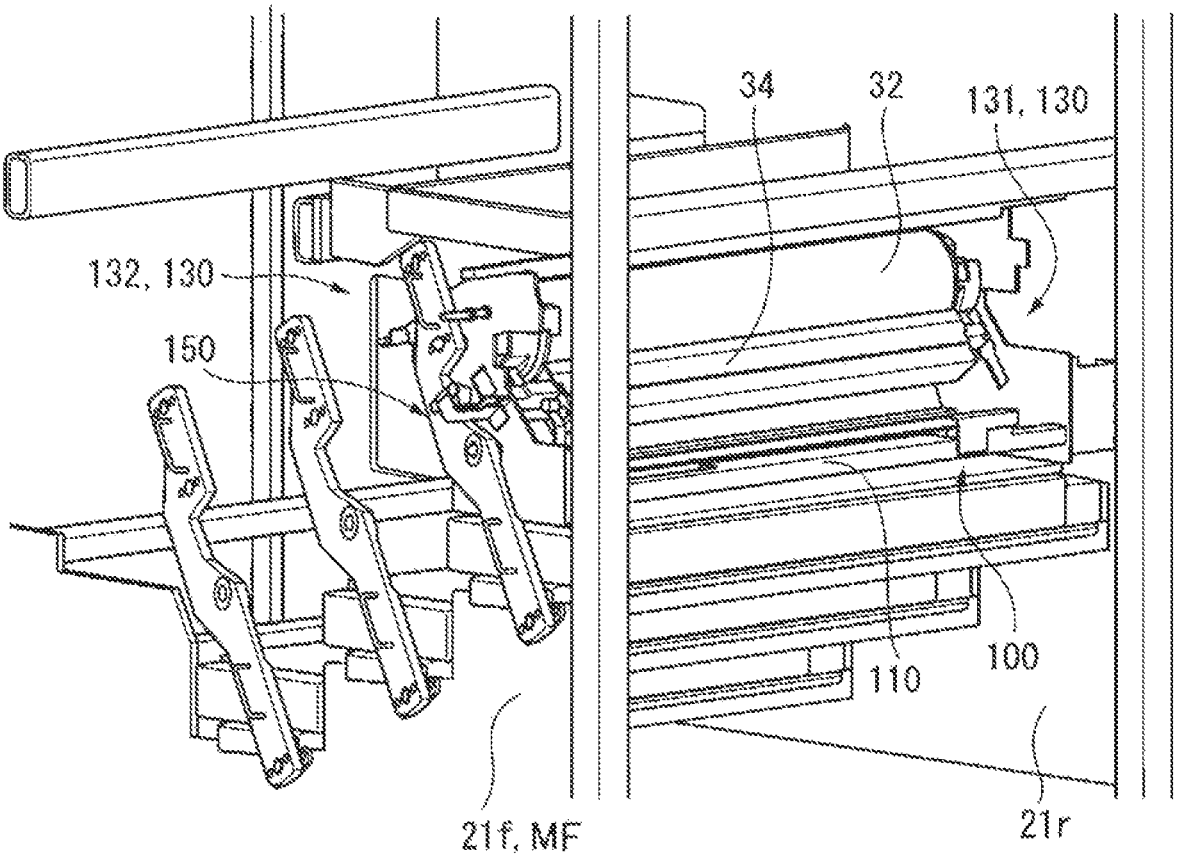
FIG. 5 illustrates a state in which the imaging module according to the first exemplary embodiment is mounted on an apparatus housing.
Figure 6:
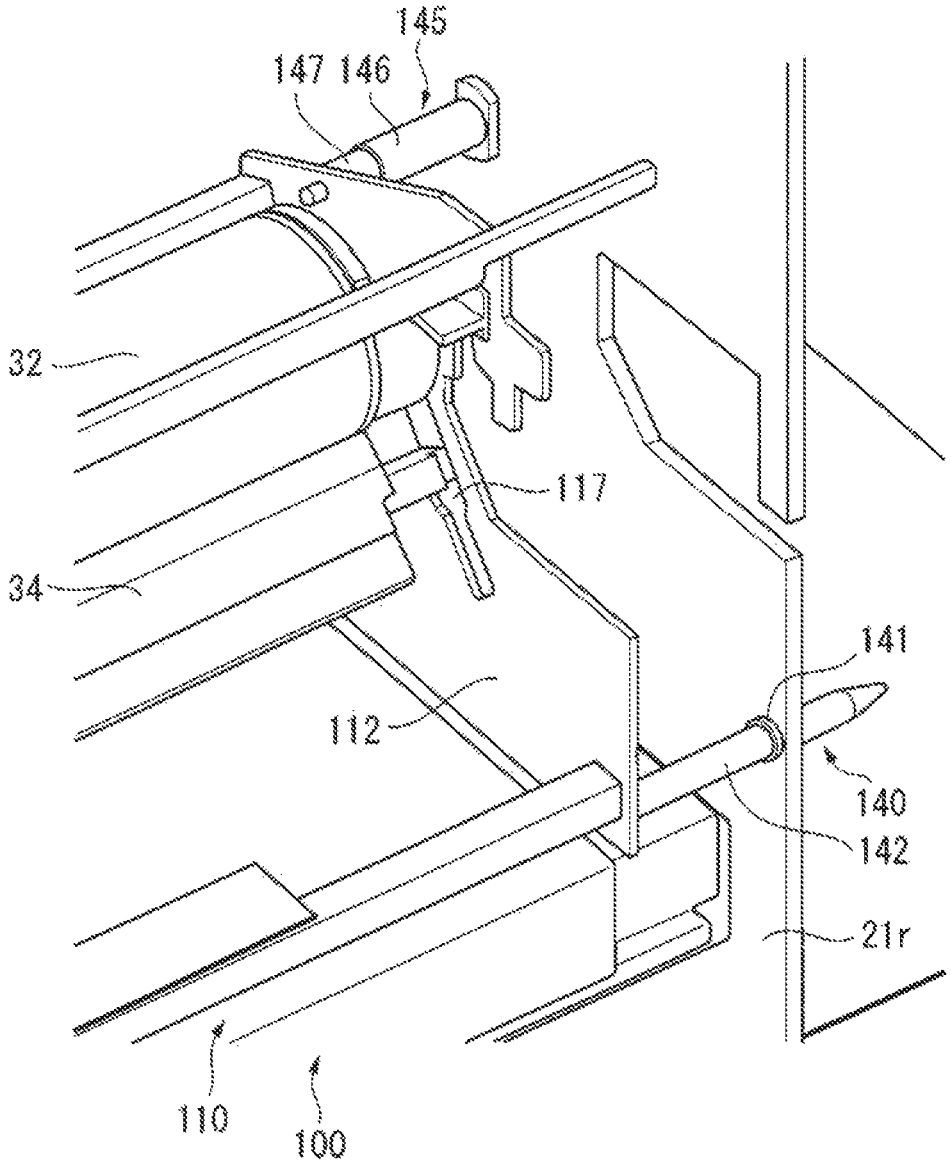
FIG. 6 illustrates a structure for fastening the imaging module illustrated in FIG. 5 to a rear frame.

In this example, the module housing 110 is formed by a plate composed of, for example, SUS and is removably mounted on the apparatus housing 21 as illustrated in FIG. 5. Example of Configuration of Apparatus Housing In this example, as illustrated in FIG. 5, the apparatus housing 21 includes a front housing frame 21*f* and a rear housing frame 21*r* as a pair of housing side frames that interpose the module housing 110 therebetween in the installation-removal direction of the imaging module 100. The front housing frame 21*f* that is located at the front in the installation-removal direction of the imaging module 100 has an opening 21*a* for installation and removal (see FIG. 13A and FIG. 13B) of the imaging module 100.

In this example, the front housing frame 21*f* includes a first frame MF that serves as the fundamental housing frame that forms the fundamental housing shape and a transfer module frame TMF that serves as a separate housing frame that is fastened to the first frame MF.

The rear housing frame 21*r* that is located at the rear in the installation-removal direction rear of the imaging module 100 is configurated by using only a first frame MF.

Mechanism for Fastening Module Housing

According to the present exemplary embodiment, as illustrated in FIG. 5, a fastening mechanism 130 for fastening the module housing 110 includes a rear register mechanism 131 that registers the hold frame 112 that is located at the rear of the module housing 110 with respect to the rear housing frame 21*r* and a front fastening mechanism 132 that registers the hold frame 111 that is located at the front of the module housing 110 with respect to the front housing frame 21*f* and that fastens the hold frame 111.

Example of Configuration of Rear Register Mechanism

According to the present exemplary embodiment, as illustrated in FIG. 5 to FIG. 8, the rear register mechanism 131 includes a central register portion 135 that registers the position of the center of the photoconductor member 32, a rotation prevention register portion 140 that registers the direction of rotation of the module housing 110, and a rough adjustment portion 145 for rough adjustment before the register with the rotation prevention register portion 140.

(1) Central Register Portion

Figure 7A:
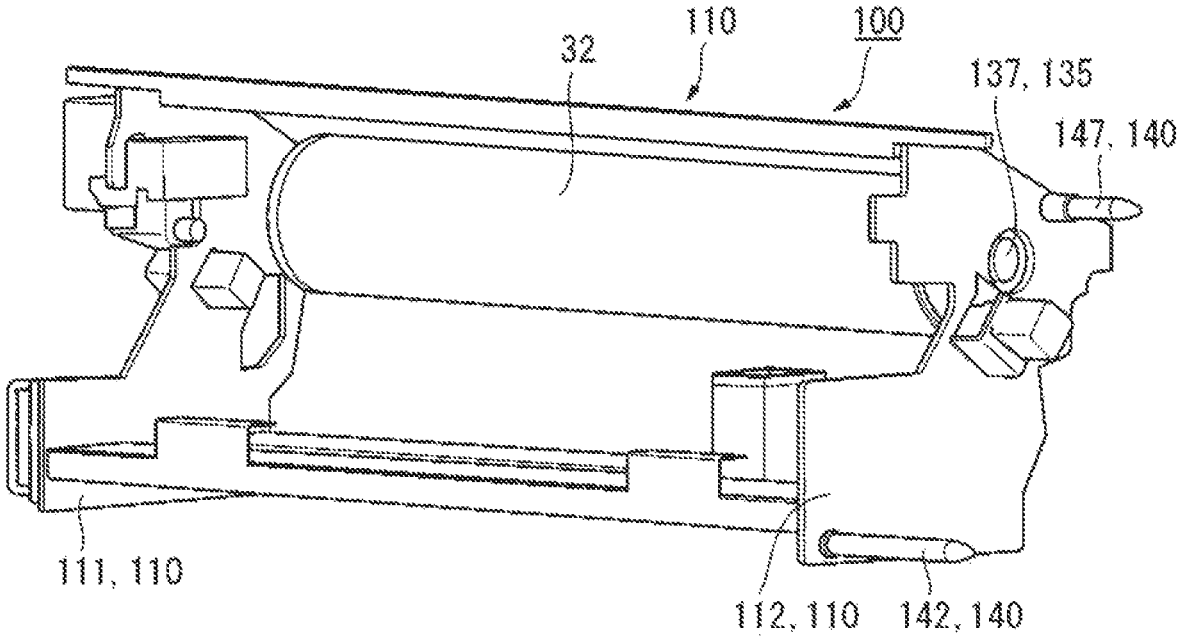
FIG. 7A illustrates a register factor of the imaging module for the rear frame.
Figure 7B:
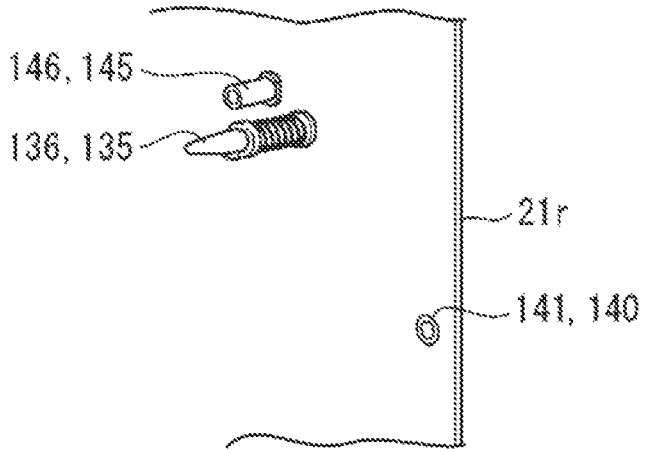
FIG. 7B illustrates a register factor of the rear frame.
Figure 8:
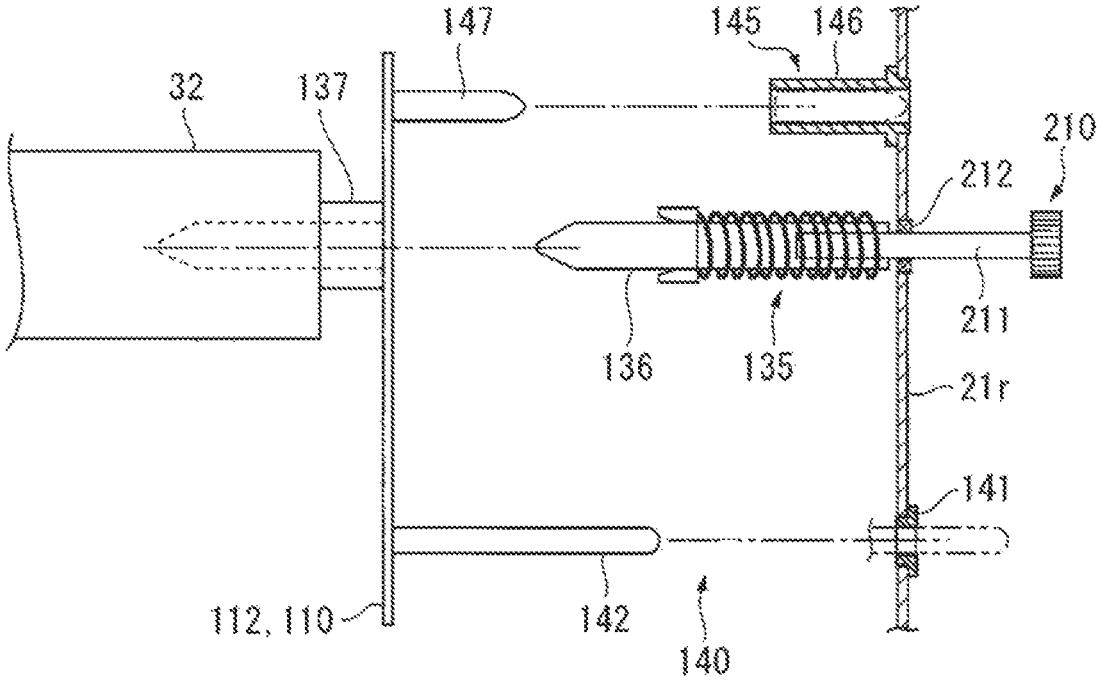
FIG. 8 schematically illustrates a relationship between the register factor of the imaging module for the rear frame and the register factor of the rear frame.
Figure 9:
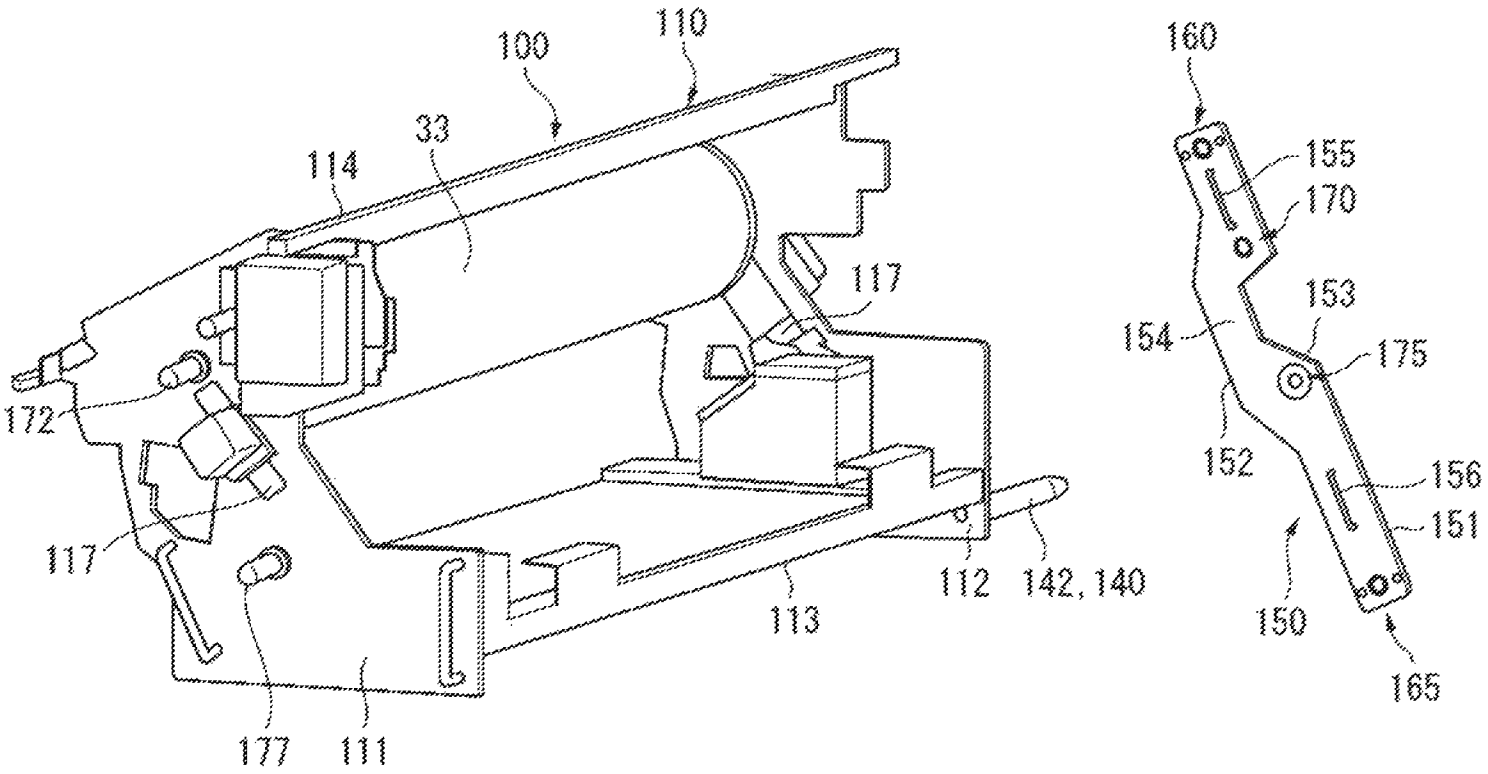
FIG. 9 illustrates a fastening arm that is used for a structure for fastening the imaging module to a front frame.
Figure 10:
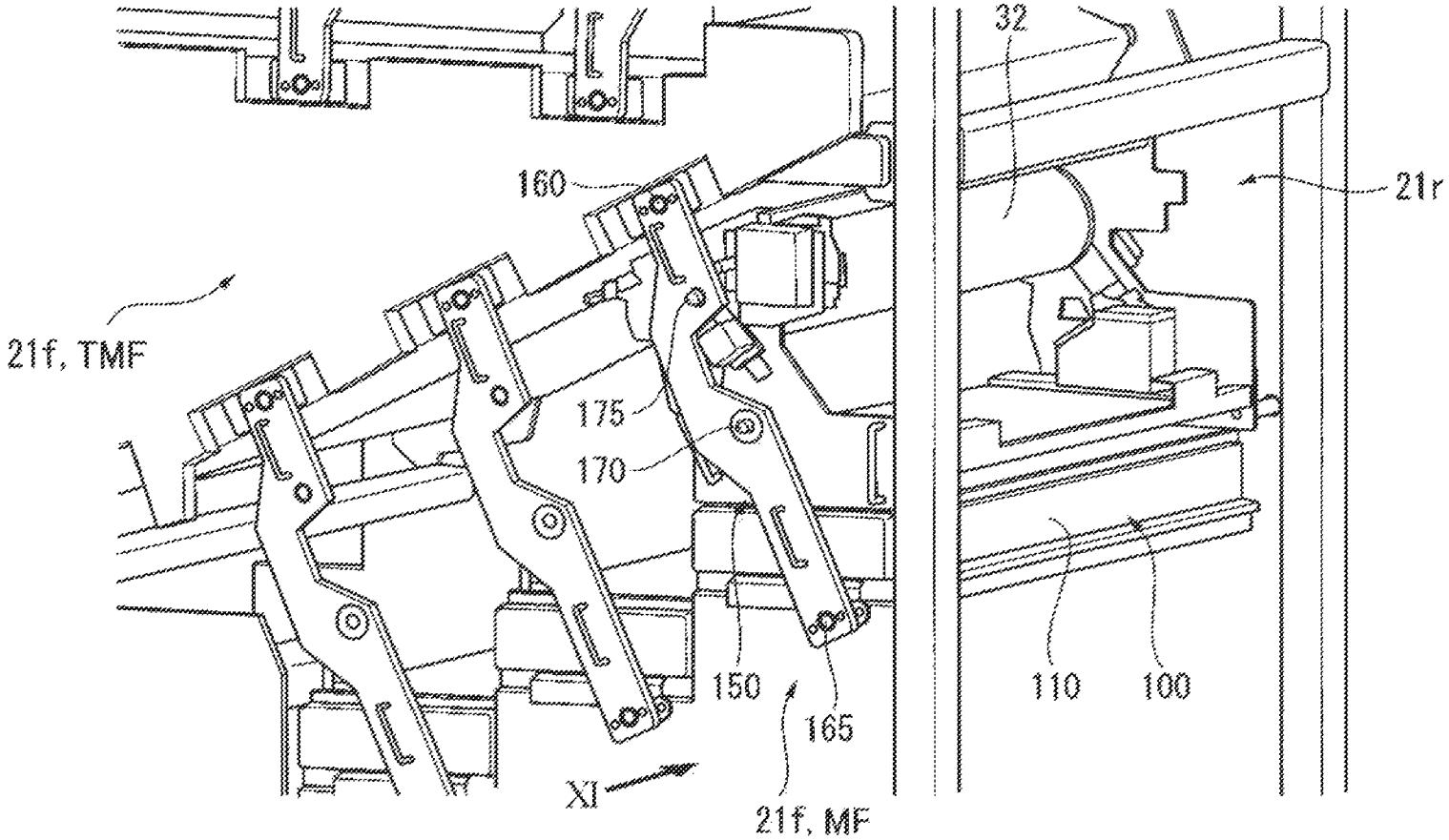
FIG. 10 illustrates a principal component of the structure for fastening the imaging module by using the fastening arm illustrated in FIG. 9.
Figure 11:
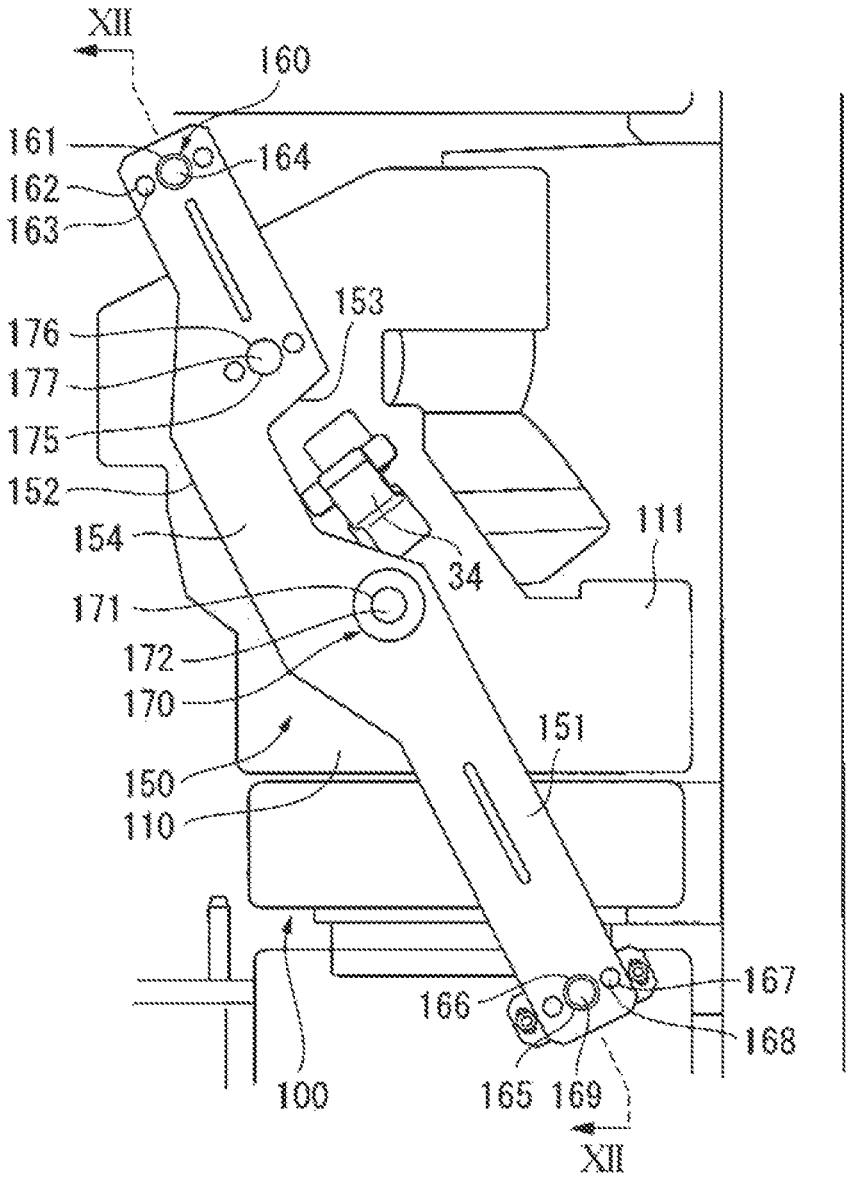
FIG. 11 illustrates a diagram viewed in the direction of an arrow XI in FIG. 10.
Figure 12:
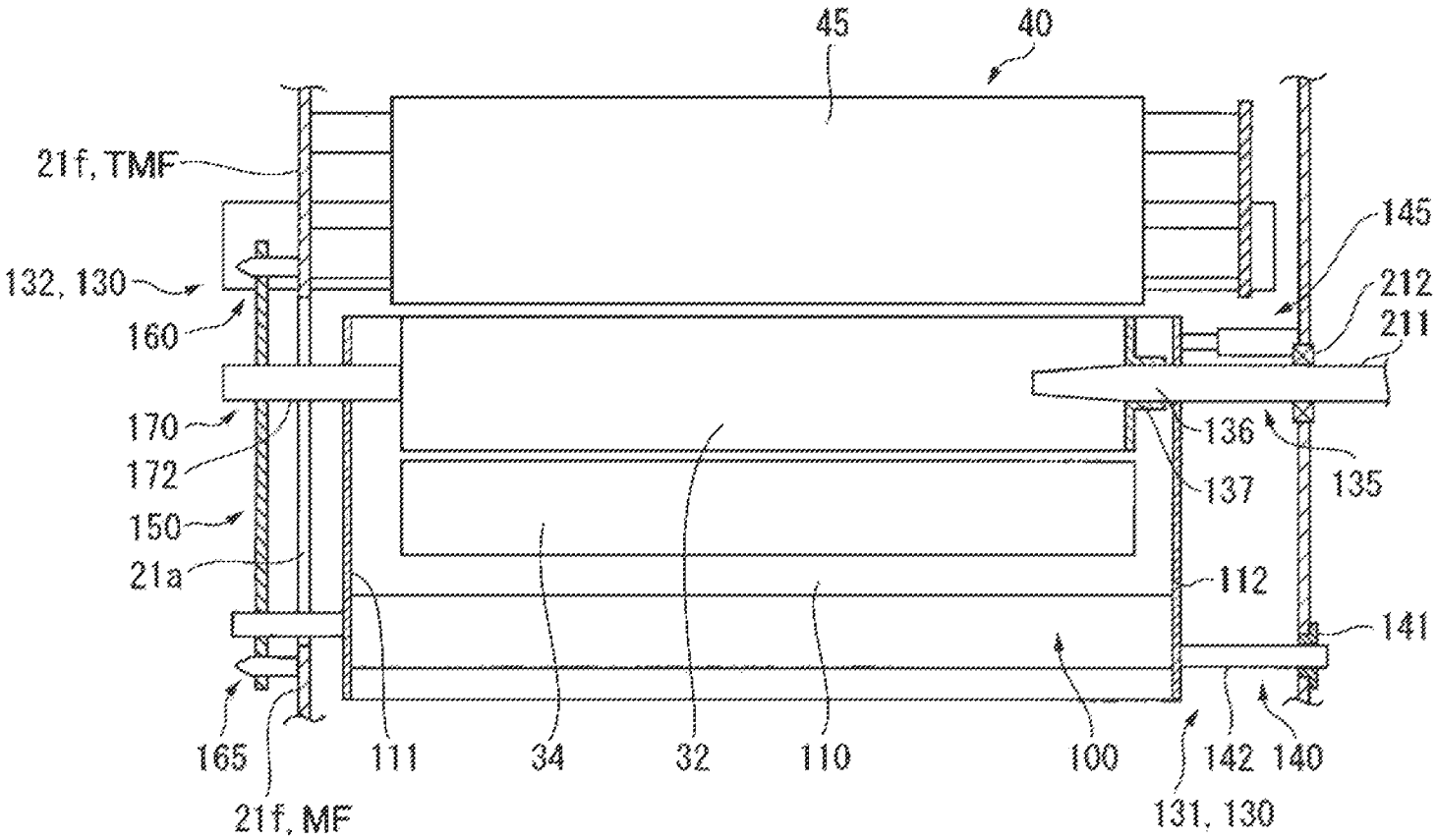
FIG. 12 illustrates a section taken along line XII-XII in FIG. 11.

In this example, as illustrated in FIG. 7B and FIG. 8, a drive shaft 211 of a drive mechanism 210 that drives rotation of the photoconductor member 32 extends through the rear housing frame 21*r* at a predetermined position with a bearing 212 interposed therebetween.

The central register portion 135 includes a support shaft 136 that is coaxially integrated into the drive shaft 211 and a coupling 137 that is coaxially disposed at the center of an end of the photoconductor member 32 in the direction of a rotation axis. A positional relationship is selected such that when the module housing 110 of the imaging module 100 is inserted toward the rear housing frame 21*r*, the support shaft 136 is first fitted into the coupling 137.

(2) Rotation Prevention Register Portion

The rotation prevention register portion 140 includes a register sleeve 141 that extends through the rear housing frame 21*r* and that is tubular at a location on the rear housing frame 21*r* away from the center axis of the photoconductor member 32, and a register shaft 142 that protrudes outward from the hold frame 112 at the rear. The rotation prevention register portion 140 prevents rotation about the center of the photoconductor member 32 by inserting the register shaft 142 into the register sleeve 141. In particular, in this example, the register shaft 142 is disposed at a position away from the center of the photoconductor member 32 and has a structure for increasing the effectiveness of prevention of the rotation.

(3) Rough Adjustment Portion

The rough adjustment portion 145 is disposed opposite the rotation prevention register portion 140 with the center of the photoconductor member 32 interposed therebetween and is disposed at a position relatively near the center of the photoconductor member 32 unlike the rotation prevention register portion 140. In this example, the rough adjustment portion 145 includes a rough adjustment sleeve 146 that is cylindrical and that protrudes toward the imaging module 100 in a hole that extends through the rear housing frame 21*r* and a rough adjustment pin 147 that protrudes from the hold frame 112 at the rear toward the rear housing frame 21*r*. The inner diameter of the rough adjustment sleeve 146 is larger than the outer diameter of the rough adjustment pin 147, and a fitting operation between these starts before the rotation prevention register portion 140 operates. The positional relationship between the register shaft 142 and the register sleeve 141 of the rotation prevention register portion 140 is roughly adjusted. It is intended to make easy to insert the register shaft 142 into the register sleeve 141.

Example of Configuration of Front Fastening Mechanism

In this example, as illustrated in FIG. 9 to FIG. 12, the front fastening mechanism 132 includes a fastening arm 150 that extends across the hold frame 111 at the front of the module housing 110 and the front housing frame 21*f*. Register points for the module housing 110 and fastening points for the front housing frame 21*f* are set at the fastening arm 150.

In this example, the fastening arm 150 includes a flange portion 152 that has a trapezoidal shape at an intermediate region on an edge of an elongated arm body 151 that has a substantially rectangular shape in a width direction intersecting the longitudinal direction and a notch portion 153 that has a trapezoidal shape opposite the flange portion 152 that has the trapezoidal shape in the width direction. A detour portion 154 for a detour around the notch portion 153 is formed in an intermediate region of the arm body 151.

First and second support portions 160 and 165 are formed as two fastening points at both ends of the arm body 151 in the longitudinal direction. First and second register portions 170 and 175 are formed as two register points with the notch portion 153 of the arm body 151 interposed therebetween in the longitudinal direction.

The first and second support portions 160 and 165 and the first and second register portions 170 and 175 are located on a substantially straight line in the longitudinal direction of the arm body 151. The straight line that connects the register points and the fastening points passes through the notch portion 153 of the arm body 151. The reason why the notch portion 153 is formed is to avoid interference between the fastening arm 150 and one of the end portions of the optical write head 34, based on the fact that register grooves 117 for registering and holding both ends portions of the optical write head 34 are formed in the hold frames 111 and 112 that are located on both sides of the module housing 110, and the one of the end portions of the optical write head 34 protrudes outward from the hold frame 111 at the front.

A grip handle 155 that has a U-shape is disposed in a region that is located between the first support portion 160 and the first register portion 170 of the arm body 151. A grip handle 156 that has a U-shape is disposed in a region that is located between the second support portion 165 and the second register portion 175 of the arm body 151.

(1) Basic Configuration of First and Second Support Portions

In this example, the first support portion 160 has a position restriction hole 161 that restricts a support position near an upper end of the arm body 151 of the fastening arm 150 and fastening holes 162 with steps with the position restriction hole 161 interposed therebetween in the width direction of the arm body 151, and fastening screws 163 are held in the respective fastening holes 162. A position restriction pin 164 that is insertable into the position restriction hole 161 is formed on the front housing frame 21*f*. The fastening screws 163 that are held in the fastening holes 162 protrude from the back of the arm body 151 and adhere to the transfer module frame TMF of the front housing frame 21*f*.

In this example, the second support portion 165 has a position restriction hole 166 that restricts a support position near a lower end of the arm body 151 of the fastening arm 150 and fastening holes 167 with steps with the position restriction hole 166 interposed therebetween in the width direction of the arm body 151, and fastening screws 168 are held in the respective fastening holes 167. A position restriction pin 169 that is insertable into the position restriction hole 166 is formed on the front housing frame 21*f*. The fastening screws 168 that are held in the fastening holes 167 protrude from the back of the arm body 151 and adhere to the first frame MF of the front housing frame 21*f*.

The position restriction pins 164 and 169 may be disposed on the front housing frame 21*f* by using a position adjustment mechanism, not illustrated, such that the positions of the fastening points are adjustable.

(2) Basic Configuration of First and Second Register Portions

As for the first register portion 170, a register hole 171 that is cylindrical is formed in the arm body 151 of the fastening arm 150, a register pin 172 that is coaxial with the rotation axis of the photoconductor member 32 is rotatably fitted into the register hole 171, and the rotation center of the photoconductor member 32 at the front is registered.

As for the second register portion 175, a rotation prevention hole 176 for rotation prevention and registering is formed in the arm body 151 of the fastening arm 150 at a position away from the register hole 171 of the first register portion 170, a rotation prevention pin 177 that protrudes toward the front and that has a circular section is formed integrally or separately on the hold frame 111 of the module housing 110 at the front, the rotation prevention pin 177 is inserted into the rotation prevention hole 176, and rotation of the imaging module 100 is consequently prevented.

In this example, the rotation prevention pin 177 is used as a rotation prevention member. Accordingly, the rotation prevention hole 176 may be circular but is not limited thereto. From the perspective of restriction on movement of the imaging module 100 in the direction of rotation due to contact with the rotation prevention member, the rotation prevention hole may be an elongated hole, the rotation prevention member may be in contact with straight edges around the elongated hole, and the rotation prevention member may not have a circular section.

Action of Module Housing with Fastening Mechanism

The fastening mechanism 130 for fastening the module housing 110 includes the rear register mechanism 131 and the front fastening mechanism 132 as described above. Accordingly, the rear register mechanism 131 registers the position of the center of the photoconductor member 32 at the rear and movement of the imaging module 100 at the rear in the direction of rotation. Subsequently, at the two register points of the fastening arm 150, the front fastening mechanism 132 registers the position of the center of the photoconductor member 32 at the front and movement of the imaging module 100 at the front in the direction of rotation. In addition, at the two fastening points of the fastening arm 150, both ends of the fastening arm 150 are fastened to the front housing frame 21*f* (the first frame MF at one of the fastening points, and the transfer module frame TMF at the other fastening point in this example).

For this reason, the module housing 110 of the imaging module 100 is registered and fastened with the module housing 110 interposed between the front housing frame 21*f* and the rear housing frame 21*r*.

Consequently, for example, when a vibration is produced by the vibration source such as a transport portion for the recording material in the image forming apparatus, the vibration is transmitted to the imaging module 100 via the apparatus housing 21. In this example, however, the module housing 110 is registered and fastened to the apparatus housing 21. For this reason, the vibration transmission path is concentrated on the imaging module 100 from the apparatus housing 21 via the module housing 110. Accordingly, the photoconductor member 32 and the optical write head 34 in the imaging module 100 vibrate together. Fastening Performance of Fastening Arm (1) Object to be Fastened at Fastening Points on Both Ends of Fastening Arm In this example, the first support portion 160 and the second support portion 165 of the fastening arm 150 are fastened to the front housing frame 21*f*. The first support portion 160 is fastened to the transfer module frame TMF. The second support portion 165 is fastened to the first frame MF.

For this reason, according to the present exemplary embodiment, when a vibration from the vibration source, not illustrated, is transmitted to the imaging module 100 via the apparatus housing 21, the vibration transmission path that extends to the first support portion 160 passes through the first frame MF and the transfer module frame TMF, and the vibration transmission path that extends to the second support portion 165 passes through only the first frame MF. For this reason, vibrations from the different vibration transmission paths are transmitted from the first support portion 160 and the second support portion 165. In this example, the fastening arm 150 registers the module housing 110 at the two register points and fastens the module housing 110 at the two fastening points. For this reason, it is presumed that vibrations from two systems are not separately transmitted to the module housing 110, but an averaged vibration is transmitted thereto. Accordingly, the photoconductor member 32 and the optical write head 34 vibrate together.

(2) Layout of Fastening Point and Register Point of Fastening Arm

In this example, the fastening points (the first and second support portions 160 and 165) and the register points (the first and second register portions 170 and 175) of the fastening arm 150 are located on the substantially straight line. In this way, a measure against the vibration mode of the fastening arm 150 may be readily planned unlike the case where the fastening points and the register points are not located on the straight line.

In this example, the optical write head 34 and the photoconductor member 32 are substantially arranged on the straight line that connects the fastening points and register points of the fastening arm 150 to each other, and accordingly, a position at which the optical write head 34 writes the image is also substantially located on the straight line described above. For this reason, the position at which the optical write head 34 writes the image is designed so as to approach a node in the vibration mode.

Operation of Installing and Removing Imaging Module

Figure 13A:
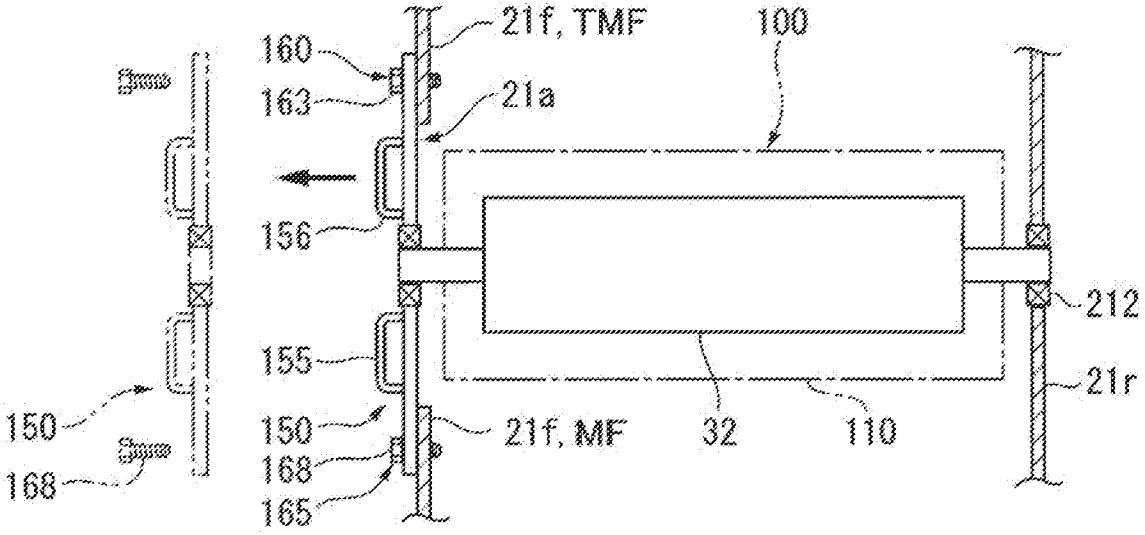
FIG. 13A illustrates the start of an operation of removing the imaging module that is installed in the apparatus housing.
Figure 13B:
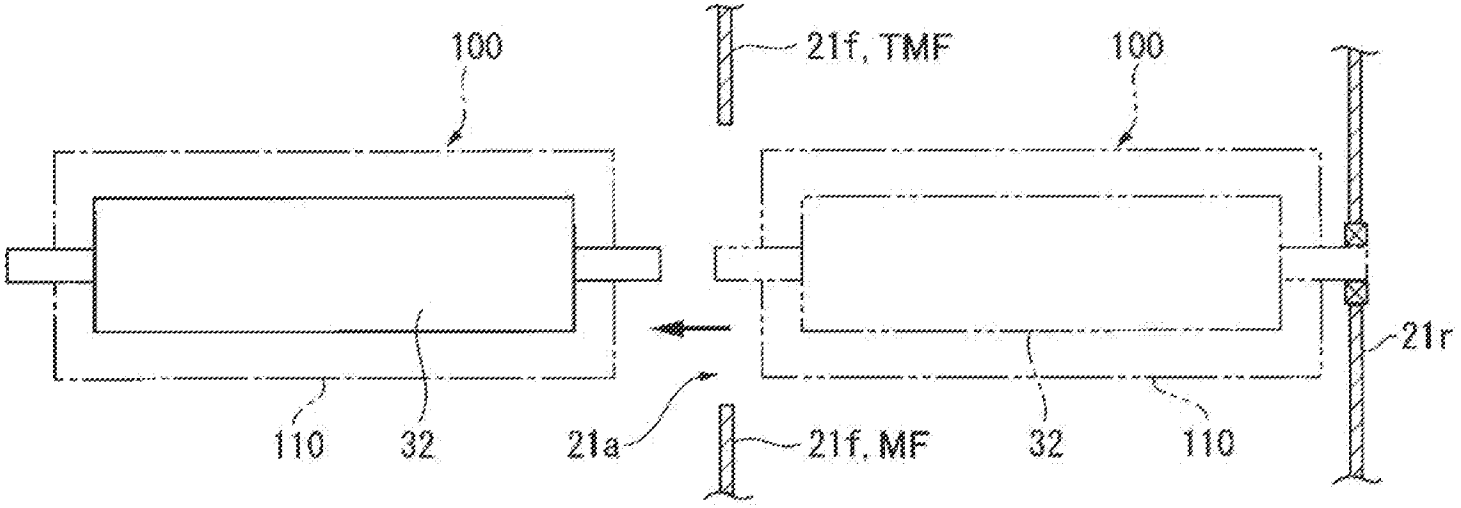
FIG. 13B illustrates a state in which the imaging module is pulled from the apparatus housing.

According to the present exemplary embodiment, in the case where the imaging module 100 is removed, as illustrated in FIG. 13A, support of the first support portion 160 and the second support portion 165 of the fastening arm 150 of the fastening mechanism 130 is released (specifically, the fastening screws 163 of the first support portion 160 and the fastening screws 168 of the second support portion 165 are removed), the grip handles 155 and 156 are gripped, the fastening arm 150 is removed from an installation position, and subsequently, the imaging module 100 is pulled via the opening 21*a* for installation and removal in the front housing frame 21*f* as illustrated in FIG. 13B.

In the case where the imaging module 100 is installed in the apparatus housing 21, as illustrated in FIG. 13B, the imaging module 100 is inserted into the apparatus housing 21 via the opening 21*a* for installation and removal in the front housing frame 21*f*. When the imaging module 100 reaches a predetermined installation position, as illustrated in FIG. 13A, the first and second register portions 170 and 175 register the fastening arm 150 and the module housing 110, and the first and second support portions 160 and 165 fasten the fastening arm 150 to the front housing frame 21*f*.

According to the present exemplary embodiment, when the imaging module 100 is installed and removed, the fastening arm 150 is configurated so as to be removed from the apparatus housing 21 once. For example, the fastening arm 150 may be supported so as to be rotatable about one of the support points of the fastening arm 150 and may be retracted once from a position at which the imaging module 100 passes through the opening 21*a* for installation and removal, for example, when the imaging module 100 is installed and removed. In this way, the fastening arm 150 may not be removed from the apparatus housing 21, and the imaging module 100 may be installed in and removed from the apparatus housing 21.

Second Exemplary Embodiment

Entire Configuration of Image Forming Apparatus

Figure 14:
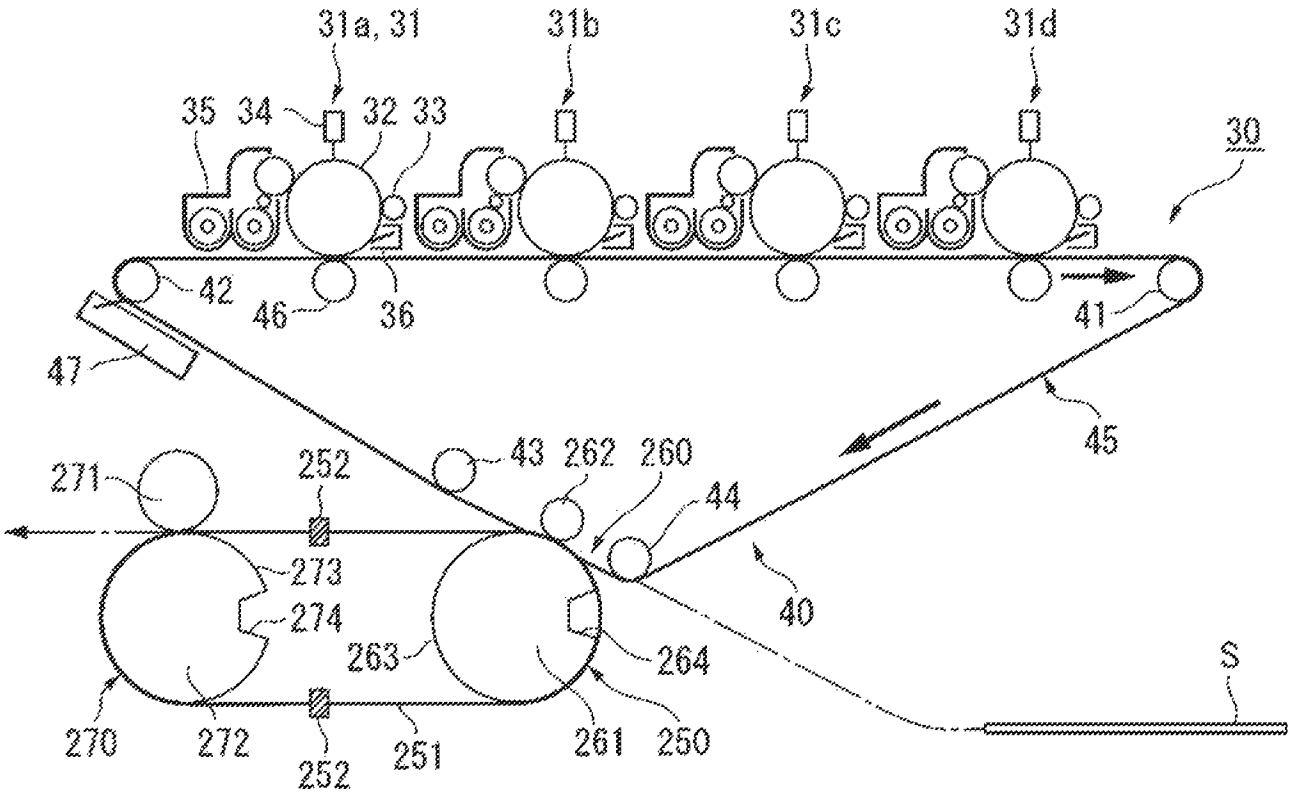
FIG. 14 illustrates the entire configuration of an image forming apparatus according to a second exemplary embodiment.

FIG. 14 illustrates the entire configuration of an image forming apparatus according to a second exemplary embodiment.

In the figure, the basic configuration of the image forming apparatus is substantially the same as that according to the first exemplary embodiment. However, the image forming apparatus differs from that according to the first exemplary embodiment in that the multiple image forming units 31 (31*a* to 31*d*) are arranged substantially in the horizontal direction, the transfer module 40 is disposed below the image forming units 31 (31*a* to 31*d*), and second transfer and fixing processes are performed while a recording material S is transported substantially in the horizontal direction.

Components like to those according to the first exemplary embodiment are designated by reference characters like to those according to the first exemplary embodiment, and a detailed description thereof is omitted herein.

In this example, as for the transfer module 40, the intermediate transfer body 45 that has a belt shape is stretched around four stretch rollers 41 to 44, a second transfer portion 260 is formed between the stretch rollers 43 and 44, a fixing portion 270 is disposed downstream of the second transfer portion 260, and the second transfer portion 260 and the fixing portion 270 are configurated by a single transport mechanism 250.

In this example, the second transfer portion 260 includes a transfer drum 261 and a charger 262 that is disposed on the back surface of the intermediate transfer body 45 that faces the transfer drum 261.

The fixing portion 270 includes a heat fixing member 271 and a pressure fixing member 272 and fixes an unfixed image to the recording material S in a fixing region therebetween.

Figure 15:
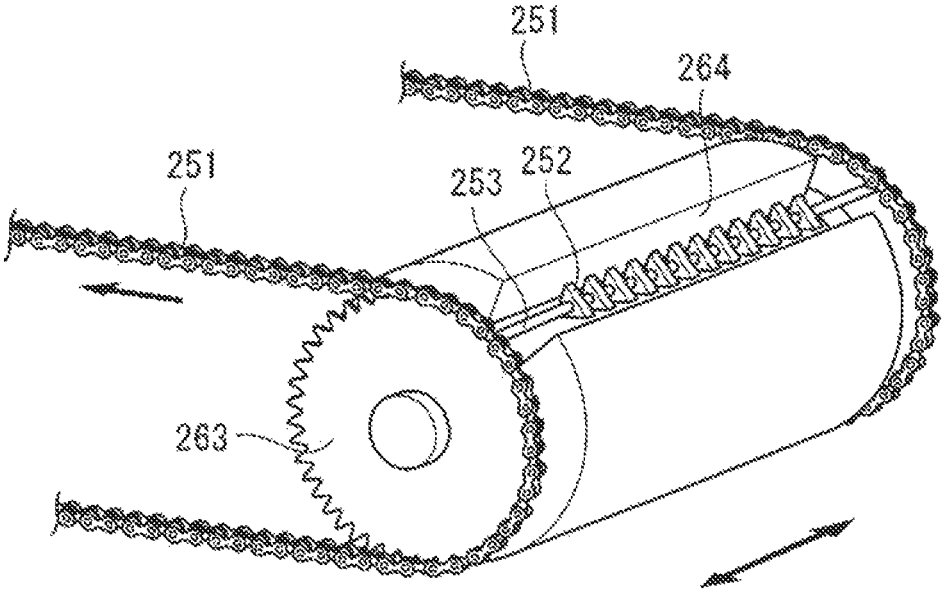
FIG. 15 illustrates an example of a transport portion that is used according to the second exemplary embodiment and that extends to a transfer portion and a fixing portion.

As illustrated in FIG. 14 and FIG. 15, the transport mechanism 250 includes a pair of chains 251 and grippers 252 that hold a leading edge of the recording material S. A mount member 253 on which the grippers 252 are mounted extends between the pair of chains 251.

The transfer drum 261 and the pressure fixing member 272 include respective pairs of sprockets 263 and 273. The pair of chains 251 are stretched around the sprockets 263 and 273, and the grippers 252 are moved. The transfer drum 261 and the pressure fixing member 272 include recessed portions 264 and 274. At positions at which the pair of chains 251 is wound around the sprockets 263 and 273, the grippers 252 move together with the transfer drum 261 in the direction of rotation of the transfer drum 261 with the grippers 252 contained in the recessed portion 264 of the transfer drum 261 and move together with the pressure fixing member 272 in the direction of rotation of the pressure fixing member 272 with the grippers 252 contained in the recessed portion 274 of the pressure fixing member 272.

Configuration of Imaging Module

According to the present exemplary embodiment, as illustrated in FIG. 14, each image forming unit 31 (31*a* to 31*d*) is configurated as the imaging module 100, and devices such as the photoconductor member 32, the charger 33, the optical write head 34, the development unit 35, and the cleaner 36 are registered and held in the single module housing 110.

Figure 16:
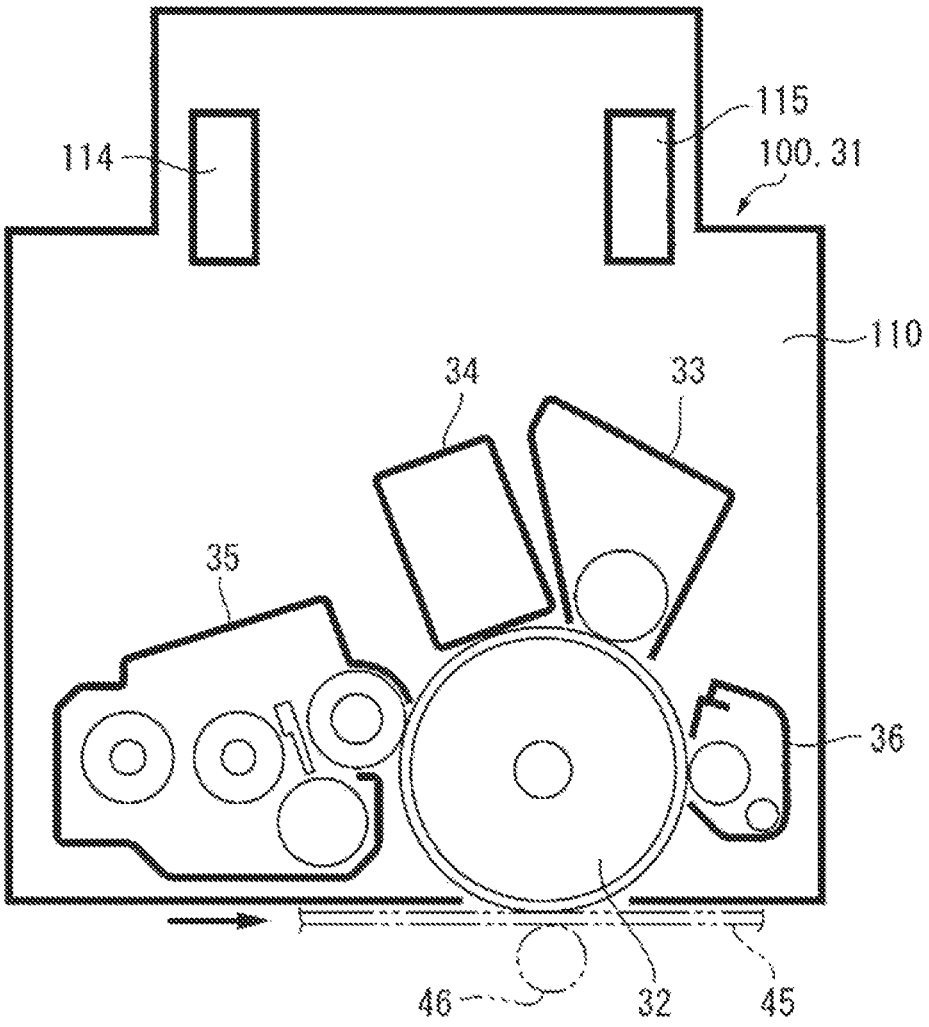
FIG. 16 illustrates a principal component of an imaging module according to the second exemplary embodiment.

In this example, as illustrated in FIG. 16, each imaging module 100 is disposed above the transfer unit 46 of the transfer module 40. The photoconductor member 32 faces the transfer unit 46. The charger 33 is disposed right above the photoconductor member 32. The optical write head 34 and the development unit 35 are arranged in the direction of rotation of the photoconductor member 32. The cleaner 36 is disposed upstream of the charger 33 in the direction of rotation of the photoconductor member 32.

Example of Configuration of Module Housing

Figure 17:
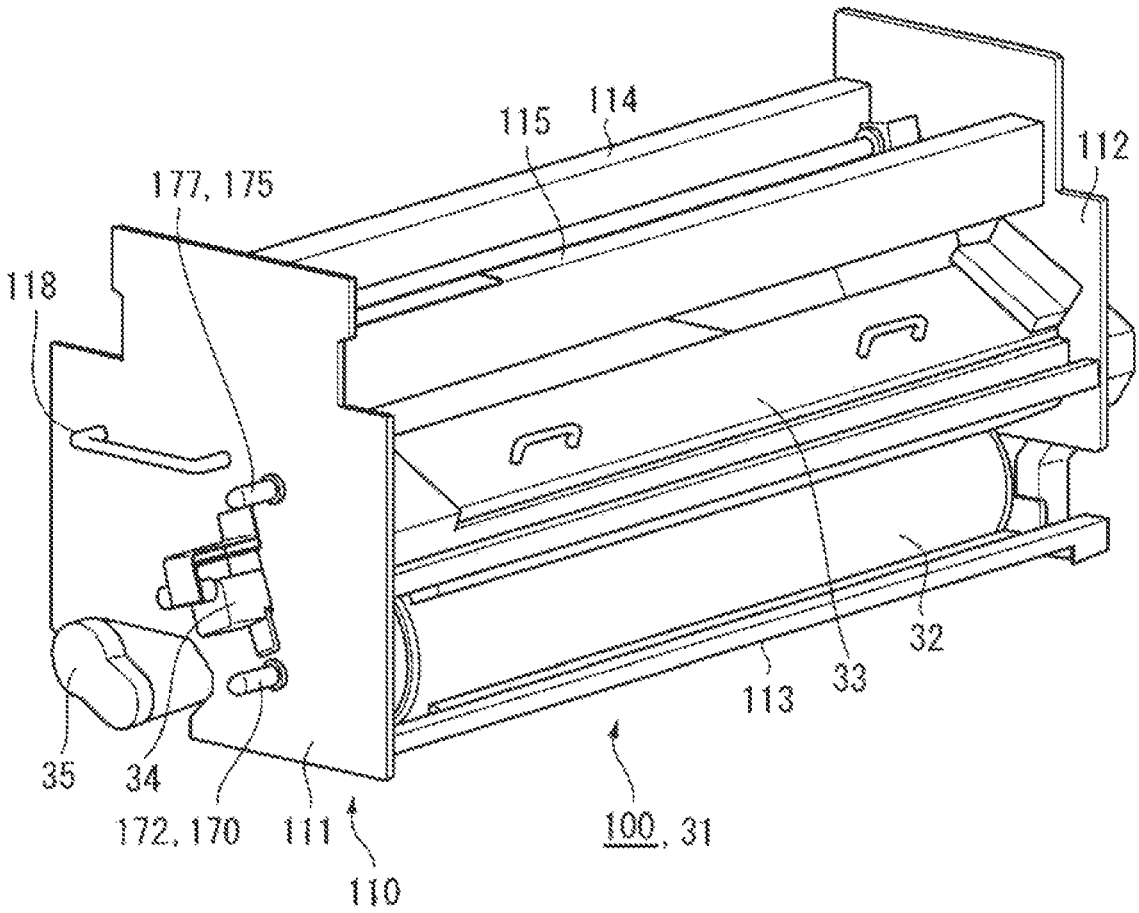
FIG. 17 is a perspective view of the imaging module illustrated in FIG. 16.

According to the present exemplary embodiment, as illustrated in FIG. 17, the basic configuration of the module housing 110 includes the pair of hold frames 111 and 112 that holds both ends of the photoconductor member 32 and the optical write head 34 in the longitudinal direction and the connection frames 113 and 114 and a connection frame 115 that connect the hold frames 111 and 112 to each other substantially as in the first exemplary embodiment. A handle 118 for the installation and removal operations is disposed at the front of the hold frame 111.

The shapes of the hold frames 111 and 112, the layouts and sectional shapes of the connection frames 113 to 115 slightly differ from those according to the first exemplary embodiment. In FIG. 17, the photoconductor member 32, the charger 33, the optical write head 34, and the development unit 35 are illustrated as devices that are incorporated in the imaging module 100, and an illustration of the cleaner 36 is omitted.

Fastening Mechanism of Module Housing

In this example, the fastening mechanism 130 for fastening the module housing 110 includes the rear register mechanism 131 and the front fastening mechanism 132 as in the first exemplary embodiment.

Figure 18:
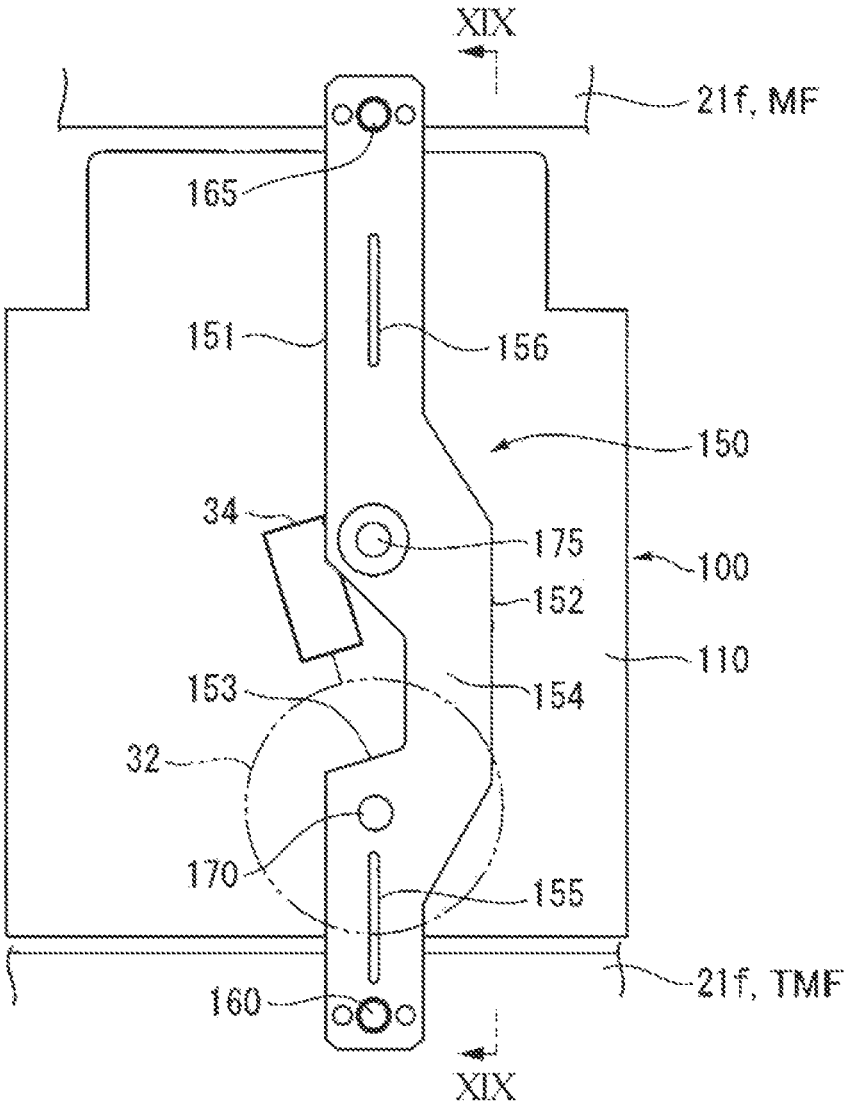
FIG. 18 illustrates a structure for fastening the imaging module that is used in the image forming apparatus according to the second exemplary embodiment to a front frame.

The rear register mechanism 131 includes the central register portion 135, the rotation prevention register portion 140, and the rough adjustment portion 145 as in the first exemplary embodiment although this is not illustrated in FIG. 17. As illustrated in FIG. 17 and FIG. 18, the front fastening mechanism 132 uses the fastening arm 150 and has the two fastening points (the first support portion 160 and the second support portion 165) and the two register points (the first register portion 170 and the second register portion 175).

In this example, however, the fastening arm 150 includes the arm body 151 that has the same shape but is turned upside down in the vertical direction and in the horizontal direction unlike the first exemplary embodiment.

Figure 19:
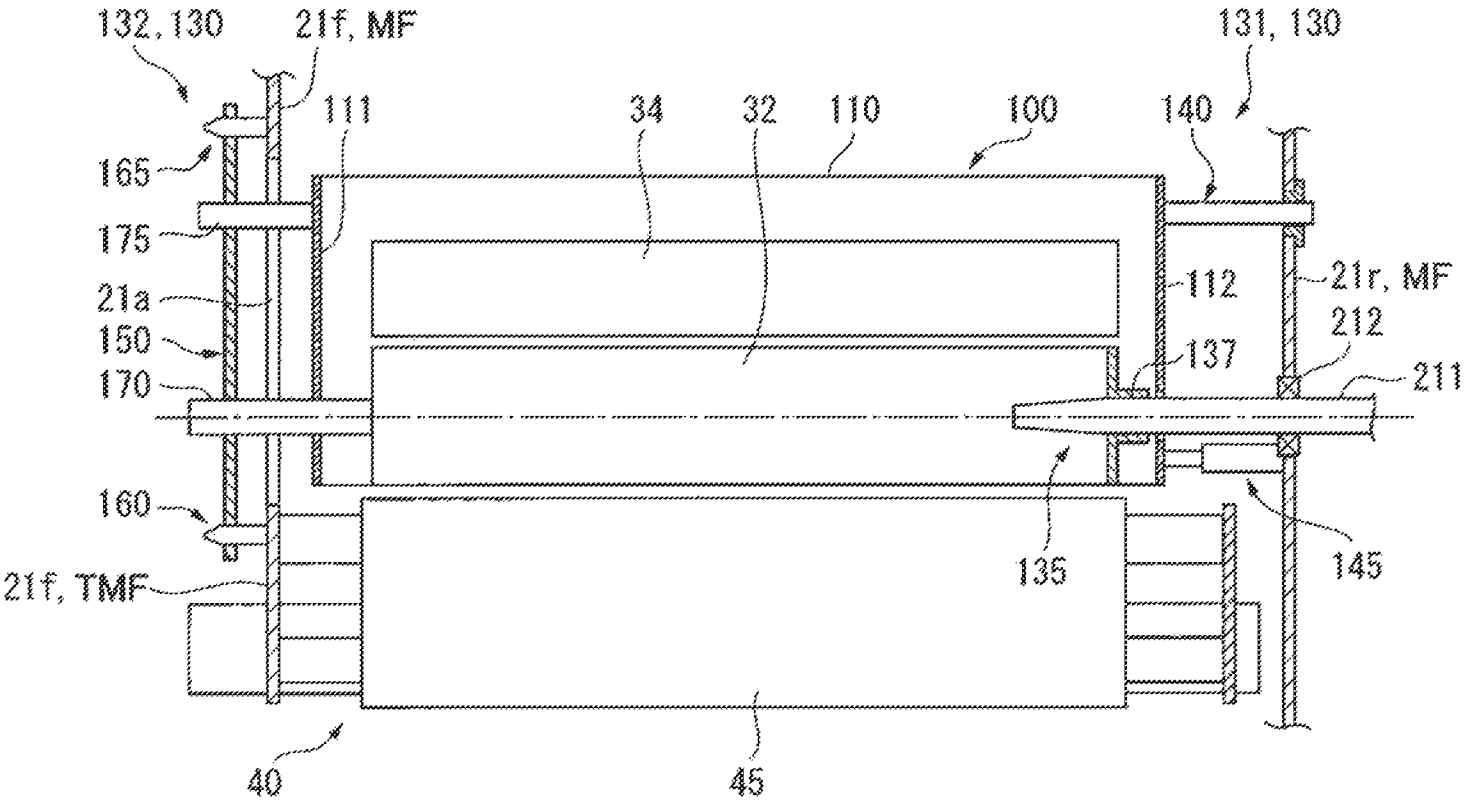
FIG. 19 illustrates a section taken along line XIX-XIX in FIG. 18.

In this example, in FIG. 18 and FIG. 19, the first support portion 160 that is located near a lower end of the fastening arm 150 is fastened to the transfer module frame TMF of the front housing frame 21*f*, and the second support portion 165 that is located near an upper end of the fastening arm 150 is fastened to the first frame MF of the front housing frame 21*f*.

Structure for Mounting Imaging Module

According to the present exemplary embodiment, the transport mechanism 250 moves the grippers 252 by using the pair of chains 251 and uses a so-called chain transport unit system in which the grippers 252 are contained in the recessed portions 264 and 274 that are formed on the transfer drum 261 and the pressure fixing member 272. Accordingly, the transport mechanism 250 becomes a large vibration source, and a vibration is transmitted via the apparatus housing 21.

According to the present exemplary embodiment, however, the photoconductor member 32 and the optical write head 34 are registered and held in the module housing 110, and the module housing 110 is registered and held in the apparatus housing 21 as in the first exemplary embodiment. Accordingly, a vibration from the vibration source is transmitted to the module housing 110 via the apparatus housing 21 as in the first exemplary embodiment. Accordingly, the vibration transmission path from the vibration source is concentrated on the apparatus housing 21 and the module housing 110, and the photoconductor member 32 and the optical write head 34 vibrate together due to the vibration that passes through the same vibration transmission path.

Operation of Installing and Removing Imaging Module

According to the present exemplary embodiment, in the case where the imaging module 100 is removed, as illustrated in FIG. 19, support of the first support portion 160 and the second support portion 165 of the fastening arm 150 of the fastening mechanism 130 is released (specifically, the fastening screws 163 of the first support portion 160 and the fastening screws 168 of the second support portion 165 are removed), the grip handles 155 and 156 are gripped, the fastening arm 150 is removed from the installation position, and subsequently, the imaging module 100 is pulled via the opening 21*a* for installation and removal in the front housing frame 21*f*.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an apparatus housing; and an imaging module that is removably installed in the apparatus housing, wherein the imaging module includes an image carrier unit that is capable of carrying an image, an image writer unit that writes an image on the image carrier unit, and a module housing that registers and removably holds the image carrier unit and the image writer unit, and wherein a fastening unit that registers the module housing with respect to the apparatus housing and that removably fastens the module housing is disposed between the apparatus housing and the module housing.

2. The image forming apparatus according to claim 1, wherein the apparatus housing includes a front housing side frame and a rear housing side frame that interpose the module housing therebetween in an installation-removal direction of the imaging module, and wherein the front housing side frame that is located at a front in the installation-removal direction of the imaging module has an opening for installation and removal of the imaging module.

3. The image forming apparatus according to claim 2, wherein the fastening unit registers the module housing with respect to the rear housing side frame that is located at a rear in the installation-removal direction of the imaging module, registers the module housing with respect to the front housing side frame with a fastening arm interposed therebetween, and fastens the module housing.

4. The image forming apparatus according to claim 3, wherein a number of support points that include a register point and a fastening point of the fastening arm of the fastening unit is larger than a number of register points of the rear housing side frame.

5. The image forming apparatus according to claim 2, wherein the module housing includes a pair of hold frames that holds both ends of the image carrier unit and the image writer unit in a longitudinal direction and a connection frame that connects the pair of hold frames to each other, and wherein a part of a register factor, or a register pin, of the fastening unit is formed on the pair of hold frames.

6. The image forming apparatus according to claim 1, wherein the fastening unit includes a register factor that registers the module housing with respect to the apparatus housing and a fastening factor that fastens the module housing to the apparatus housing.

7. The image forming apparatus according to claim 6, wherein the register factor includes a plurality of portions to be registered at a predetermined location on the module housing and a plurality of register portions that is disposed on the apparatus housing or the fastening unit and that is involved with the plurality of portions to be registered.

8. The image forming apparatus according to claim 6, wherein the fastening factor is configurated such that a fastening position is adjustable and is capable of fastening the module housing that is registered after the module housing is registered with respect to the apparatus housing.

9. The image forming apparatus according to claim 1, wherein the fastening unit includes a fastening arm that is disposed across the apparatus housing and the module housing, and a register point for the module housing and a fastening point for the apparatus housing are set at the fastening arm.

10. The image forming apparatus according to claim 9, wherein the fastening arm includes an elongated arm member that has two ends at which the fastening points for the apparatus housing are set, and a position of a center of the image carrier unit and a position on the image carrier unit at which the image writer unit writes the image are located on a straight line that connects the fastening points to each other.

11. The image forming apparatus according to claim 9, wherein the apparatus housing includes a fundamental housing frame that forms a fundamental housing shape of the image forming apparatus and a separate housing frame that is fastened to the fundamental housing frame, and wherein with the fastening arm disposed across the fundamental housing frame and the separate housing frame, a number of support points that include the register point and the fastening point is larger than the number of support points in a case where the fastening arm is disposed across only the fundamental housing frame.

12. The image forming apparatus according to claim 1, wherein a transport unit that transfers and fixes an image that is formed by the imaging module to a recording material is disposed in the apparatus housing.

13. An image forming apparatus, comprising:

apparatus housing means;

imaging means that is removably installed in the apparatus housing means, the imaging means including image carrier means for carrying an image, image writer means for writing an image on the image carrier means, and module housing means for registering and removably holding the image carrier means and the image writer means; and fastening means for registering the module housing means with respect to the apparatus housing means and for removably fastening the module housing means, the fastening means being disposed between the apparatus housing means and the module housing means.

* * * * *